US011866875B2

(12) United States Patent
Lee et al.

(10) Patent No.: US 11,866,875 B2
(45) Date of Patent: Jan. 9, 2024

(54) LAUNDRY TREATING APPARATUS

(71) Applicant: LG Electronics Inc., Seoul (KR)

(72) Inventors: Jihong Lee, Seoul (KR); Kwanwoong Jeong, Seoul (KR); Minsu Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 87 days.

(21) Appl. No.: 17/495,286

(22) Filed: Oct. 6, 2021

(65) Prior Publication Data

US 2022/0120013 A1 Apr. 21, 2022

(30) Foreign Application Priority Data

Oct. 15, 2020 (KR) ..... 10-2020-0133618

(51) Int. Cl.

| | |
|---|---|
| ***D06F 39/02*** | (2006.01) |
| ***D06F 37/18*** | (2006.01) |
| ***D06F 39/08*** | (2006.01) |
| ***D06F 39/10*** | (2006.01) |
| ***D06F 39/14*** | (2006.01) |

(52) U.S. Cl.

CPC ..... *D06F 39/02* (2013.01); *D06F 37/18* (2013.01); *D06F 39/088* (2013.01); *D06F 39/10* (2013.01); *D06F 39/14* (2013.01)

(58) Field of Classification Search

CPC ..... D06F 39/02; D06F 39/10; D06F 39/14; D06F 39/088; D06F 37/18

USPC ..... 68/17 R

See application file for complete search history.

(56) References Cited

U.S. PATENT DOCUMENTS

| | | | | |
|---|---|---|---|---|
| 2009/0320213 | A1* | 12/2009 | Hyun et al. | A47L 15/4234 68/3 R |
| 2010/0018258 | A1* | 1/2010 | Cho | D06F 39/088 68/17 R |
| 2015/0143856 | A1 | 5/2015 | Jo et al. | |
| 2017/0002494 | A1* | 1/2017 | Lee | D06F 39/00 |
| 2018/0179690 | A1 | 6/2018 | Cheon et al. | |

FOREIGN PATENT DOCUMENTS

| | | |
|---|---|---|
| CN | 103726272 | 4/2014 |
| CN | 206448067 | 8/2017 |
| CN | 109281131 | 1/2019 |
| JP | 2002-119795 | 4/2002 |

OTHER PUBLICATIONS

Extended European Search Report in European Appln. No. 21199691.3, dated Mar. 15, 2022, 10 pages.

Office Action in Chinese Appln. No. 202111142586.1, dated Apr. 28, 2023, 19 pages (with English translation).

* cited by examiner

*Primary Examiner* — Tinsae B Ayalew

(74) *Attorney, Agent, or Firm* — Fish & Richardson P.C.

(57) ABSTRACT

A laundry treating apparatus includes a housing, a tub, and a top cover. The tub is provided in the housing, and the top cover is provided above the housing. The top cover receives water and detergents and supply the water and detergents to the tub. The top cover is provided in two configurations so that the degree of freedom of manufacturing may be improved.

29 Claims, 9 Drawing Sheets

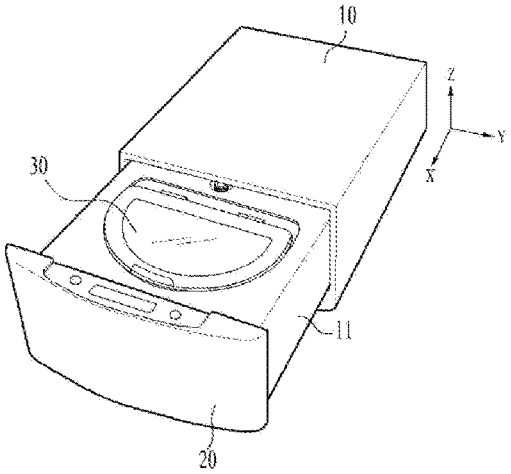
FIG. 1A
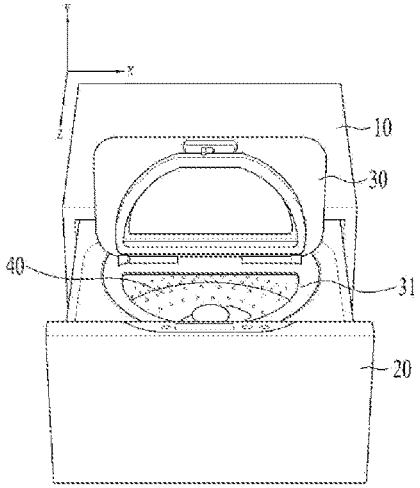
FIG. 1B
FIG. 2
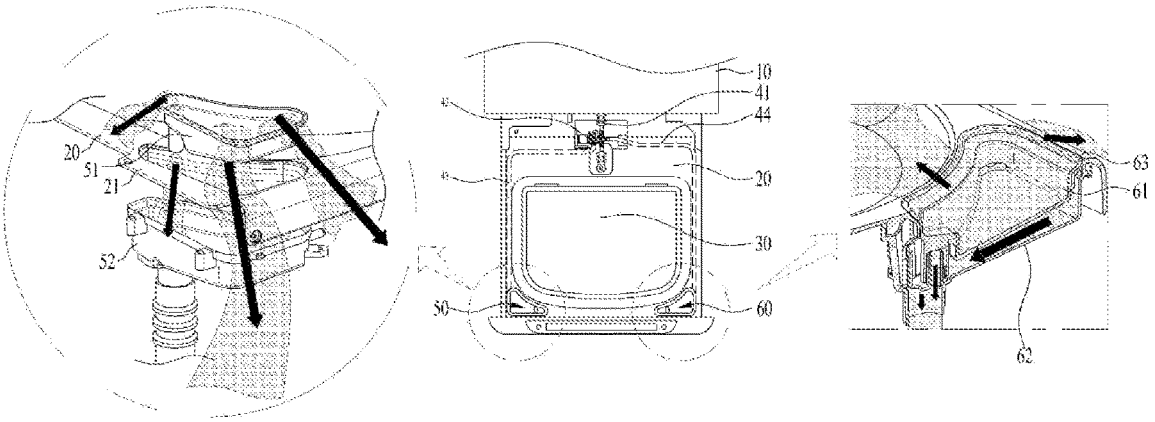

FIG. 3
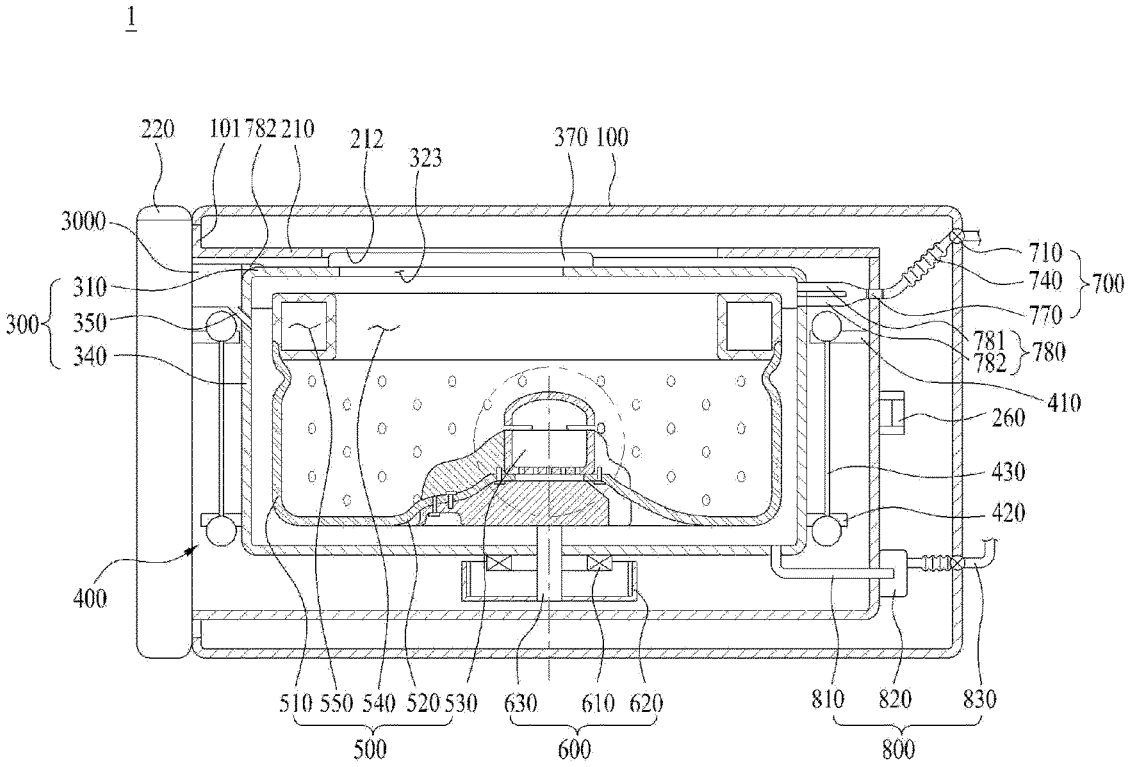
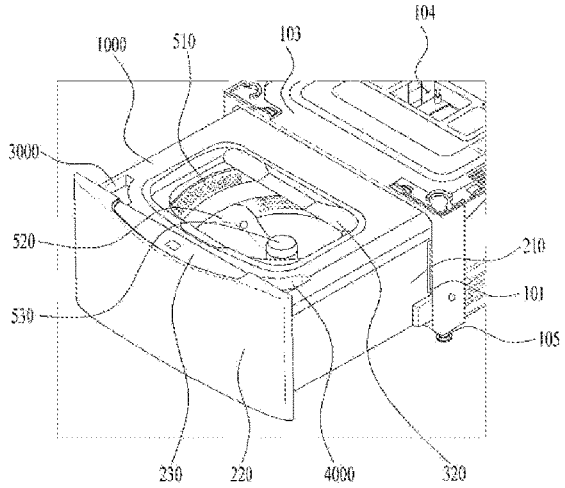
FIG. 4A
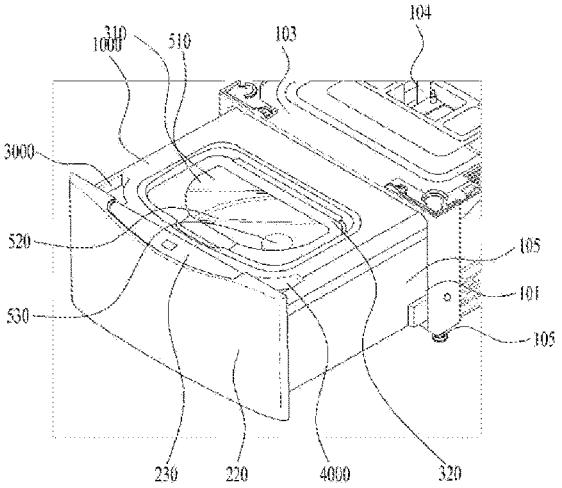
FIG. 4B

LAUNDRY TREATING APPARATUS

CROSS-REFERENCE TO RELATED APPLICATION

This application claims the benefit of Korean Patent Application No. 10-2020-0133618,5 filed on Oct. 15, 2020, which is hereby incorporated by reference as if fully set forth herein.

TECHNICAL FIELD

The present disclosure relates to a laundry treating apparatus.

BACKGROUND

In general, a laundry treating apparatus refers to an apparatus for washing, drying, or washing and drying laundry. That is, the laundry treating apparatus may perform either or both washing and drying functions. In recent years, a washing machine having a refresh function such as wrinkle removal, odor removal, static electricity removal, etc. has been provided with a steam supply device.

Typically, each home may have one large-capacity laundry treating apparatus. When clothes are sorted by types and then washed separately, the laundry treating apparatus needs to be used multiple times. For example, since adult clothes need to be washed separately from underwear or baby clothes, the laundry treating apparatus is used again after washing of the former is completed. As a result, not only the time required for washing but also the amount of consumed energy increase.

In particular, the laundry courses of a large laundry treating apparatus are designed mostly for a large amount of laundry, so that a relatively large amount of water is consumed. In addition, a large amount of power is also required to rotate a large drum. Thus, the large laundry treating apparatus may not be suitable for washing delicate fabrics such as underwear or baby clothes.

The large laundry treating apparatus may not be suitable even when a small amount of laundry is frequently washed. A situation may arise where consumers collect laundry over a period of days or more to wash the laundry at a time. However, it is not good in terms of cleanliness that underwear or baby clothes are left unattended for a long time. If left unattended for a long time, foreign substances adhere to the fabric, so that it may be difficult to do laundry.

To solve this problem, a small laundry treating apparatus with a much smaller capacity than a large laundry treating apparatus may be used. Such a small laundry treating apparatus may be designed to be suitable for washing a small amount of laundry because the laundry treating apparatus has a small size, and more particularly, because the height of a tub is smaller than the width of the tub.

However, if two laundry treating apparatuses are placed side by side in a home, it may be undesirable and inefficient in terms of space utilization.

To solve the above problem, a laundry treating apparatus capable of integrating a small laundry treating apparatus and a large laundry treating apparatus has been introduced in recent years (see Korean Patent Publication No. 10-2018-0023287).

FIGS. 1A and 1B show a structure of a conventional small laundry treating apparatus.

The conventional small laundry treating apparatus may be placed at the top or bottom of a typical large laundry treating apparatus. To place the conventional small laundry treating apparatus under the large laundry treating apparatus, the conventional small laundry treating apparatus may be provided as a top-loading type or a drawer type for user accessibility.

Referring to FIG. 1A, the conventional laundry treating apparatus includes a cabinet 10 defining the exterior thereof and configured to support an upper laundry treating apparatus, and a drawer 20 configured to be pulled out from the cabinet 10. The cabinet 10 may include an opening 11 through which the drawer 20 is pulled out.

Referring to FIG. 1B, the drawer 20 may include a laundry storage space 40 configured to store water or hold laundry, and an inlet 31 through which laundry is put may be provided on the top surface of the laundry storage space 40. The height of the laundry storage space 40 is configured to be smaller than the width of the laundry storage space 40, and as a result, water or laundry may be discharged through the inlet 31.

Accordingly, the conventional laundry treating apparatus may additionally include a door 30 configured to open and close the inlet 31 to prevent discharge of water or laundry. The door 30 may be configured to rotate on the upper surface of the drawer 20 or on the laundry storage space 40. A user may open the inlet 31 by rotating the door 30 if necessary, and rotate the door 30 again toward the inlet 31 to insert the drawer 20 into the cabinet 10 to operate the laundry treating apparatus.

The conventional laundry treating apparatus has limitations in that the drawer 20 should be pulled out from the cabinet 10 in order to open the inlet 31. That is, since the door 30 is configured to rotate on the drawer 20 or the laundry storage space 40 and the cabinet 10 is limited in height, there is a limitation in that the door 30 does not open inside the cabinet 10.

Accordingly, when the user opens the inlet 31 to dry the interior of the laundry storage space 40 after using the laundry treating apparatus, the drawer 20 always needs to be withdrawn from the cabinet 10.

Therefore, when the laundry storage space 40 is naturally drying, the drawer 20 may obstruct the passage of the user, or the space utilization of the cabinet 10 may be significantly degraded.

When the drawer 20 is pulled out, the cabinet 10 may fall in a direction in which the drawer 20 is pulled out if there is no laundry treating apparatus at the top of the cabinet 10.

In the conventional laundry treating apparatus, when the drawer 20 is withdrawn during washing, a rotational moment may be generated by the weight of the drawer 20 and the weight of water and laundry, so that the cabinet 10 may turn over.

Since the drawer 20 may not be withdrawn during the washing, no fabric softener may be injected during the washing. That is, it is difficult to guarantee that the effects of both a detergent and a fabric softener will work.

To solve this problem, a small laundry treating apparatus including a plurality of detergent boxes has been introduced to control the injection time of a detergent and fabric softener (see Korean Patent Publication No. 10-2019-0009620).

FIG. 2 shows a structure of a conventional small laundry treating apparatus including a detergent box.

The conventional laundry treating apparatus may include a detergent box 50 provided on a first front side of an upper cover 21 of a drawer 20, a softener box 60 provided on a second front side of the upper cover 21, a first pipe 43 configured to supply water to the detergent box 50, and a second pipe 44 configured to supply water to the softener box 60. In addition, the first pipe 43 and the second pipe 44 may be branched from a water supply pipe 41, and a valve 42 configured to control the direction of water may be provided at the branch point.

Thus, when a user puts a detergent into the detergent box 50, puts a softener into the softener box 60, closes the door 30, and inserts the drawer 20 into a cabinet 10, water may be supplied through the first pipe 43 and the second pipe 44 at an appropriate time, so that the detergent and softener may be supplied to the laundry storage space 40. In other words, the user does not need to forcefully pull out the drawer 20 from the cabinet 10 to inject the detergent and softener into the laundry storage space 40.

The detergent box 50 may include a detergent cover 51 into which the detergent is injected and a detergent housing 52 configured to accommodate the detergent cover 51 and supply the water and detergent in the detergent cover 51 to a tub.

The softener box 60 may include a softener cover 61 into which the softener is injected, a softener housing 62 configured to accommodate the softener cover 61 and supply the water and softener in the softener cover 61 to the tub, and a blocking cover 63 configured to prevent the water supplied from the softener cover 61 from overflowing out of the softener housing 62.

The detergent housing 52 and the softener housing 62 may be separated from each other and connected to the first pipe 43 and the second pipe 44, respectively.

In this case, since the drawer 20 and the laundry storage space 40 are provided in small sizes, the detergent housing 52 and the softener housing 62 are also relatively small in volume. In addition, a space between the drawer 20 and the laundry storage space 40 may need to be small to secure the laundry volume of the laundry storage space 40, and thus the volume of each of the detergent housing 52 and the softener housing 62 may become insufficient.

However, to supply a proper amount of the detergent in the detergent cover 51 and a proper amount of the softener in the softener cover 61 to the laundry storage space 40, excessive amounts of water need to be provided through the first pipe 43 and the second pipe 44, compared to the volumes of the detergent housing 52 and the softener housing 62.

Thus, when water is supplied to the detergent housing 52 and the softener housing 62, all of the water may not flow into the tub. That is, some water may overflow out of the detergent housing 52 and the softener housing 62.

In particular, when the detergent housing 52 and the softener housing 62 are provided in a siphon structure for water supply as shown in FIG. 2, if excessive amounts of water are supplied, some water may overflow out of the detergent housing 52 and the softener housing 62.

Further, since the detergent housing 52 and the softener housing 62 are separated and spaced apart from each other, connection pipes configured to connect the detergent housing 52 and the softener housing 62 with the laundry storage space 40 need to be also provided separately. In particular, since the space between the laundry storage space 40 and the drawer 20 is small, installing the connecting pipes is quite complicated, so that the production process is lengthened.

In the conventional laundry treating apparatus, the upper cover 21 of the drawer 20 is provided in a simple plate shape to cover the space between the drawer 20 and the laundry storage space 40. However, in this case, it may be problematic that the upper cover 21 of the drawer 20 does not well accommodate and support the first pipe 43, the second pipe 44, the detergent box 50, and the softener box 60.

Therefore, extra components may be required to attach or fix the first pipe 43, the second pipe 44, the detergent box 50, and the softener box 60 to the bottom surface of the upper cover 21, and an additional process may also be required to couple the components to the upper cover 21.

In addition, there is a possibility that the first pipe 43, the second pipe 44, the detergent box 50, and the softener box 60 may be separated from the upper cover 21.

Further, even if the first pipe 43, the second pipe 44, the detergent box 50, and the softener box 60 are fixed to the upper cover 21, the first pipe 43, the second pipe 44, the detergent box 50, and the softener box 60 may be exposed under the drawer 20. As a result, the laundry storage space 40 may collide and interfere with the first pipe 43, the second pipe 44, the detergent box 50, and the softener box 60, or the first pipe 43, the second pipe 44, the detergent box 50, and the softener box 60 may be corroded by the water or detergent of the laundry storage space 40.

Since the upper cover 21 is exposed to the outside, the upper cover 21 should be made of a metal material for rigidity. That is, it is difficult to shape the upper cover 21, thereby degrading the degree of manufacturing freedom.

SUMMARY

Accordingly, the present disclosure is directed to a laundry treating apparatus that substantially obviates one or more problems due to limitations and disadvantages of the related art.

An object of the present disclosure is to provide a laundry treating apparatus capable of opening a door that opens and closes a laundry storage space inside a cabinet.

Another object of the present disclosure is to provide a laundry treating apparatus capable of expanding the volume of a detergent box containing a detergent and the volume of a softener box containing a softener or another detergent.

Another object of the present disclosure is to provide a laundry treating apparatus for preventing water from overflowing out of a detergent box containing a detergent and a softener box containing a softener or another detergent.

Another object of the present disclosure is to provide a laundry treating apparatus for simplifying or unifying a structure for connecting a detergent box containing a detergent and a softener box containing a softener or another detergent to a tub.

Another object of the present disclosure is to provide a laundry treating apparatus for preventing a detergent box containing a detergent, a softener box containing a softener or another detergent, and a supply pipe for supplying water to the detergent box and the softener box from being exposed inward.

Another object of the present disclosure is to provide a laundry treating apparatus for accommodating and supporting at least parts of a detergent box containing a detergent, a softener box containing a softener or another detergent, and a supply pipe for supplying water to the detergent box and the softener box.

Another object of the present disclosure is to provide a laundry treating apparatus including a plurality of top covers above a laundry storage space, which differ in material and shape.

Another object of the present disclosure is to provide a laundry treating apparatus with no detergent box.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, the present disclosure provides a laundry treating apparatus configured to receive water directly through a top cover disposed above a housing in which a tub is mounted.

Specifically, since the top cover is configured to directly receive water and detergents, no detergent boxes may be required to add the detergents. Of course, the laundry treating apparatus may include a detergent box configured to contain a softener or bleach because a time at which the softener or bleach is added is important. The detergent box may also be provided on a duct disposed in the top cover.

There may be no problem even if water overflows out of the detergent box because the duct of the top cover has a larger volume than the detergent box. Therefore, the amount of water supplied to the detergent box may further increase, and no components may be required to prevent water from overflowing out of the detergent box.

The top cover may include the duct configured to store water or allow the water to flow somewhere, and detergents may be inserted directly through the duct. The duct of the top cover may be connected to the tub to supply water and detergents.

A plurality of detergent boxes may be directly mounted in the top cover.

The top cover may be configured to support a part of a water supply portion and a lower portion of the detergent box. The top cover may prevent the water supply portion and the detergent box from being exposed inside a cabinet.

The top cover may be configured to receive both a detergent and softener and supply the detergent and softener to the tub through one junction pipe.

In the top cover, a portion containing the detergent may be connected to a portion containing the softener.

In the top cover, the volume of the portion in containing the detergent may be larger than that of the portion containing the softener.

Two or more pieces of components may be provided above the housing. Specifically, an auxiliary cover coupled above the top cover as well as the top cover may be provided above the housing. In this case, the top cover may be made of a material that is easily shape-shifted and processed, and the auxiliary cover may be made of a material having high rigidity or corrosiveness.

The top cover may be configured to support a part of a water supply pipe or accommodate or support a detergent supply portion.

The top cover may have a space for installing a detergent box, a water supply path, and a valve.

In another aspect of the present disclosure, the laundry treating apparatus may include a housing; a tub provided in the housing and configured to store water; a drum rotatably provided in the tub and configured to receive laundry; a water supply portion configured to supply water to the tub; a first detergent supply portion configured to receive a first detergent to be supplied to the tub; a second detergent supply portion spaced apart from the first detergent supply portion and configured to receive a second detergent to be supplied to the tub; and a top cover coupled to an upper portion of the housing and configured to receive the first detergent from the first detergent supply portion and receive the second detergent from the second detergent supply portion.

The top cover may include a junction duct configured to receive the water from the water supply portion and supply the first detergent and the second detergent to the tub.

The junction duct may be disposed in front of and above the tub.

The junction duct may be coupled to or mounted on an upper portion of the housing.

The junction duct may include: a first receiving portion configured to receive the first detergent from the first detergent supply portion; a second receiving portion configured to receive the second detergent from the second detergent supply portion; a transfer portion configured to connect the first receiving portion and the second receiving portion; and a junction hole connected to the tub by passing through the transfer portion.

The transfer portion may have a smaller width than the first receiving portion and the second receiving portion.

The width of the transfer portion may decrease from the first receiving portion and the second receiving portion toward the junction hole.

The junction hole may have a lower height than the first receiving portion and the second receiving portion.

Each of the first receiving portion and the second receiving portion may have a higher height than the transfer portion.

The height of the transfer portion may decrease from the first receiving portion and the second receiving portion toward the junction hole.

The first receiving portion and the second receiving portion may be provided at both ends of the junction duct, respectively, and the transfer portion may be disposed between the first receiving portion and the second receiving portion.

The transfer portion may include: a first filter provided between the first receiving portion and the junction hole; and a second filter provided between the second receiving portion and the junction hole.

The tub may further include an injection pipe connected to the junction hole, and the injection pipe may be spaced and disposed at a shortest distance between the junction hole and the tub.

The junction duct may further include: an integrated pipe that extends outward from the junction hole and is configured to allow the first detergent and the second detergent to flow therethrough; and a junction pipe configured to connect the integrated pipe and the injection pipe and supply the first detergent and the second detergent to the tub.

The junction pipe may be a corrugated pipe or may be made of an elastic material.

The first receiving portion, the second receiving portion, and the transfer portion may be disposed in front of the tub.

The water supply portion may include: a water supply valve disposed behind the tub; a first supply pipe extending from the water supply valve to the first receiving portion; and a second supply pipe extending from the water supply valve to the second receiving portion.

The top cover may further include an extension portion that extends from both ends of the junction duct to a rear of the housing and is coupled to both sides of the housing. The extension portion may be configured to support at least a part of the first supply pipe and at least a part of the second supply pipe.

The laundry treating apparatus may include the auxiliary cover coupled to an upper portion of the junction duct and an upper portion of the extension portion and configured to prevent the junction duct and the extension portion from being exposed outward. The first detergent supply portion and the second detergent supply portion may pass through the auxiliary cover or may be mounted on the auxiliary cover.

The first detergent supply portion may include a first detergent injection hole provided on an upper portion of the first receiving portion by passing through the auxiliary cover.

The second detergent supply portion may include: a second detergent injection hole provided on a upper portion of the second receiving portion by passing through the auxiliary cover; and a detergent housing inserted into the second detergent injection hole to receive the second detergent and connected to the second supply pipe.

The laundry treating apparatus may further include a cabinet having an opening through which the housing is inserted and withdrawn. The auxiliary cover may be coupled to a part of the top cover exposed from the cabinet.

The transfer portion may be connected to the first receiving portion and the second receiving portion on a top of the tub.

The transfer portion may be connected to the first receiving portion and the second receiving portion so that the first detergent supplied to the first receiving portion is transferred to the second receiving portion or the second detergent supplied to the second receiving portion is transferred to the first receiving portion.

The transfer portion may include a junction hole configured to supply to the tub the first detergent supplied to the first receiving portion and the second detergent supplied to the second receiving portion.

The junction hole may have a lower height than the first receiving portion and the second receiving portion.

The transfer portion may have a smaller width than the first receiving portion and the second receiving portion.

The width of the transfer portion may decrease from the first receiving portion and the second receiving portion toward the junction hole.

The laundry treating apparatus may further include an auxiliary cover coupled above the top cover and configured to prevent the water supply portion or the detergent supply portion from being exposed outward.

The top cover may be configured to support a lower portion of the water supply portion or a lower portion of the detergent supply portion.

The water supply portion may include: a branch portion disposed on a rear surface of the housing and configured to receive water from an external water supply source; and a supply pipe extending from the branch portion and configured to supply the water to the detergent supply portion, The top cover may include an extension portion configured to detachably support the supply pipe on at least one of both sides thereof, and the auxiliary cover may be configured to cover the extension portion.

The extension portion may include coupling steps that extend outward stepwise and coupled to and mounted on both sides of the auxiliary cover.

The top cover may further include an installation portion configured to support a water level sensor configured to detect a water level of the tub.

The housing may be provided such that a part of the top cover is withdrawn from a cabinet having a front opening, and the auxiliary cover may have an area corresponding to the part of the top cover exposed outside the cabinet.

The top cover and the auxiliary cover may be made of different materials.

It is to be understood that both the foregoing general description and the following detailed description of the present disclosure are exemplary and explanatory and are intended to provide further explanation of the disclosure as claimed.

As it is apparent from the above description, the present disclosure has the following effects.

According to the present disclosure, a door that opens and closes a laundry storage space may open inside a cabinet.

According to the present disclosure, the volume of a detergent box containing a detergent and the volume of a softener box containing a softener or another detergent may expand.

According to the present disclosure, it is possible to prevent water from overflowing out of a detergent box containing a detergent and a softener box containing a softener or another detergent.

According to the present disclosure, a structure for connecting a detergent box containing a detergent and a softener box containing a softener or another detergent to a tub may be simplified or unified.

According to the present disclosure, it is possible to prevent a detergent box containing a detergent, a softener box containing a softener or another detergent, and a supply pipe for supplying water to the detergent box and the softener box from being exposed inward.

According to the present disclosure, it is possible to accommodate and support at least parts of a detergent box containing a detergent, a softener box containing a softener or another detergent, and a supply pipe for supplying water to the detergent box and the softener box.

According to the present disclosure, no detergent box may be required.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

FIGS. 1A and 1B show a conventional laundry treating apparatus.

FIG. 2 shows a water supply structure of a conventional laundry treating apparatus.

FIG. 3 shows an internal structure of a laundry treating apparatus according to the present disclosure.

FIGS. 4A and 4B show an appearance of the laundry treating apparatus according to the present disclosure.

DETAILED DESCRIPTION

Figure 5:
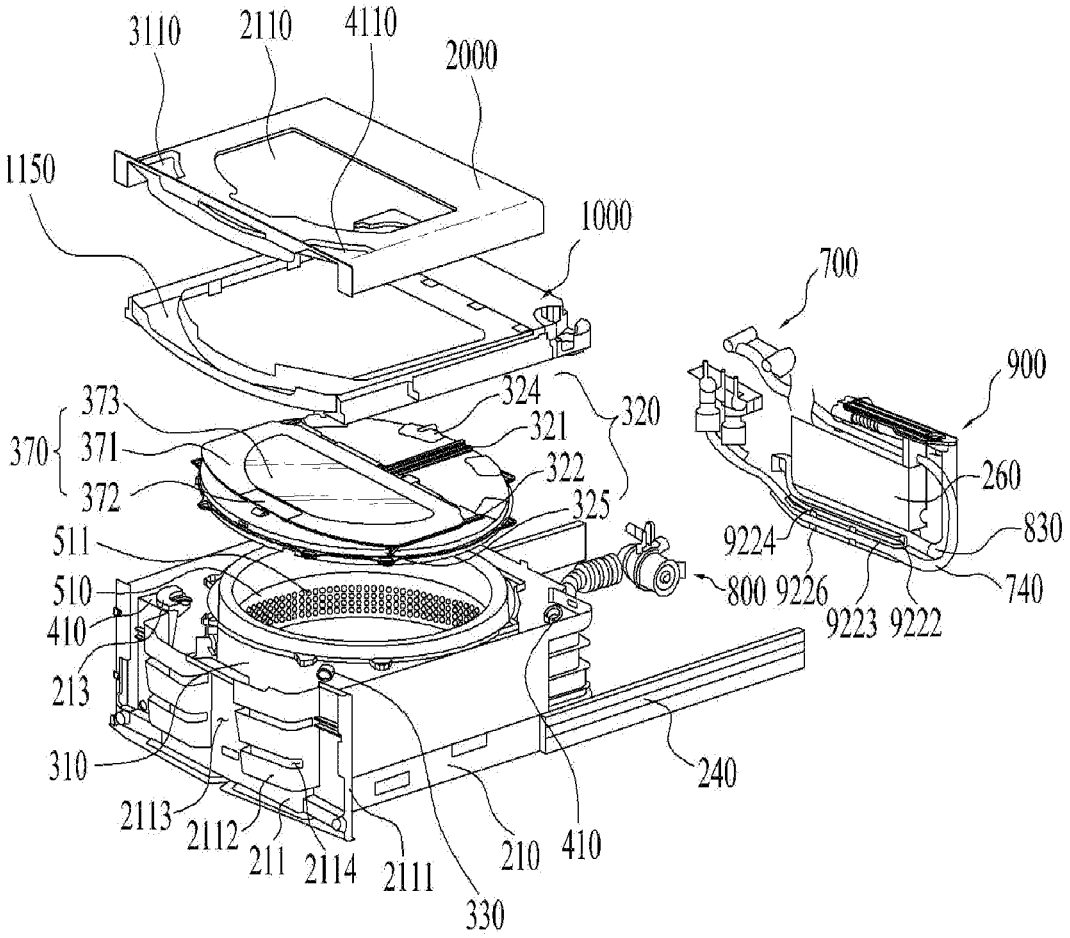
FIG. 5 shows an exploded perspective view of the laundry treating apparatus according to the present disclosure.

Hereinafter, implementations of the present disclosure will be described in detail with reference to the attached drawings. In this specification, the same or equivalent components will be provided with the same reference numbers, and description thereof will not be repeated. A singular expression includes a plural concept unless there is a contextually distinctive difference therebetween. If it is determined that detailed descriptions of the related art obscure the gist of the present disclosure, the detailed descriptions thereof will be omitted. Further, it should also be understood that the attached drawings are merely to provide better understanding of the implementations of the present disclosure and the spirit of the present disclosure is not limited to the attached drawings.

FIG. 3 shows an internal structure of a laundry treating apparatus according to the present disclosure.

The laundry treating apparatus 1 according to the present disclosure may include a tub 300 configured to store water, a drum 500 configured to rotate inside the tub 300 and accommodate laundry, and a driver 600 coupled to the bottom of the tub 300 and configured to rotate the drum 500.

In this case, the laundry treating apparatus according to the present disclosure may include a housing 100 and 200 in which the tub 300 is provided. The housing may be formed in a box shape where the height is smaller than the width.

The housing may be provided as a cabinet 100 configured to accommodate the tub 300.

The cabinet 100 may be formed in a box shape where the height is smaller than the width.

The housing may include a drawer 200 configured to accommodate the tub 300 and be pulled out from the cabinet 100.

In other words, the laundry treating apparatus according to the present disclosure may be provided as a drawer type as shown in FIG. 3. However, this is merely exemplary. That is, the laundry treating apparatus according to the present disclosure may include a general cabinet with no drawer.

When the laundry treating apparatus according to the present disclosure is the drawer type, the cabinet 100 may include an opening 101 through which the drawer 200 is withdrawn. When the laundry treating apparatus according to the present disclosure has no drawer, the opening 101 may be disposed on the upper surface of the cabinet 100 so that the cabinet 100 may be connected to the inlet of the tub 300.

Hereinafter, the laundry treating apparatus according to the present disclosure will be described on the assumption of the drawer type, but this is only for explanation. That is, the present disclosure may also include a top-loading type laundry treating apparatus.

The drawer 200 may include a drawer body 210 configured to accommodate the tub 300 and a drawer panel 220 provided in front of the drawer body 210 and configured to open and close the opening 101.

The drawer body 210 may include an open surface 212 configured to connect the tub 300 to the outside and put laundry in and out. Based on the shape of the cabinet 100, the drawer body 210 may be formed in a box shape where the height is smaller than the width.

A control panel 230 may be installed in the drawer panel 220. Specifically, the control panel 230 may be provided in front of the drawer body 210 and configured to receive commands from a user. The control panel 230 may be provided on the upper surface of the drawer panel 220 so that the user may easily access the control panel 230. The control panel 230 may include an input unit configured to receive commands and a display unit configured to display the state of the laundry treating apparatus. Both the input unit and the display unit may be implemented with a touch panel. Alternatively, the input unit may be provided as buttons, and the display unit may be provided as a display.

The tub 300 may include a tub body 310 configured to provide a volume for storing water, and a tub cover 320 coupled above the tub body 310. The height of the tub body 310 may be smaller than the width thereof, and a driver 600 configured to rotate the drum 500 may be coupled and fixed to a lower outer surface of the tub body 310. The tub body 310 may be formed in a cylindrical shape so that the tub body 310 may have a different cross-sectional shape from the drawer body 210.

The tub cover 320 may be coupled to the tub body 310 to prevent water in the tub body 310 or laundry in the drum 500 from being discharged out of the tub body 310. The tub cover 320 may be provided in the shape of a disk or a thin cylinder, and may include an inlet 323 through which laundry is put into the drum 500.

The area of the inlet 323 may be smaller than the area of the tub body 310 and tub cover 320, and may be spaced apart from the inner circumferential surface of the tub cover 320 by a predetermined distance.

The drum 500 may include a drum body 510 accommodated in the tub body 310 and configured to rotate, and a pulsator 520 protruding from the bottom surface of the drum body 510 and configured to agitate laundry or form a water flow.

The drum body 510 may be formed in a cylindrical shape and have a plurality of through holes through which water is injected along the periphery. A laundry inlet 511 connected to the inlet 323 may be provided on the upper surface of the drum body 510.

The pulsator 520 and the drum body 510 may be integrated. That is, the pulsator 520 may be formed by pressing the bottom surface of the drum body 510, or may be coupled to the inside of the bottom surface of the drum body 510. In addition, the pulsator 520 may be configured to rotate on the bottom surface of the drum body 510.

A filter 530 configured to remove foreign substances from the water in the tub body 310 may be disposed above the pulsator 520.

The filter 530 may be formed in the shape of a housing to allow water to be injected into lower and upper surfaces. The filter 530 may be formed in a circular shape to minimize friction with laundry. The water in the tub body 310 may be injected into a lower portion of the filter 530 and discharged from an upper portion of the filter 530 when the drum 500 rotates. While the water moves in the opposite direction, foreign substances may be collected inside the filter 530. A plurality of through holes may be provided on the upper or lower surface of the filter 530 to allow the water to flow but prevent the foreign substances from being discharged.

The laundry treating apparatus according to the present disclosure may further include a supporter 400 configured to support the tub 300 inside the drawer 200. The supporter 400 may include a tub bracket extending from the outer surface of the tub body 310, a drawer bracket disposed above the tub bracket inside the drawer body 210, and a support bar configured to support the load of the tub 300 by connecting the tub bracket tub and the drawer bracket.

The supporter 400 may further include at least one of a spring and a rubber damper disposed on the outer circumferential surface of the support bar to absorb or reduce vibration.

The laundry treating apparatus according to the present disclosure may further include a water supply portion 700 configured to supply water to the tub 300, and a drainage portion 800 configured to drain water from the tub 300.

The water supply portion 700 may include a water supply connector 710 disposed on one surface of the cabinet 100 and connected to a water supply hose coupled to an external water supply source, and a water supply valve 750 connected to the water supply connector 710 and configured to control the amount of supplied water.

The water supply valve 750 may be coupled to the water supply connector 710.

The water supply valve 750 may be disposed and fixed to the drawer body 210. Thus, the water supply valve 750 may stably supply water into the drawer 200 regardless of whether the drawer 200 is pulled out from the cabinet 100.

When the water supply valve 750 is provided in the drawer body 210, the water supply portion 700 may further include a water supply pipe 740 configured to connect the water supply valve 750 and the water supply connector 710.

The laundry treating apparatus according to the present disclosure may further include a detergent box 3000 configured to receive water from the water supply portion 700 and supply a detergent to the tub 300. The detergent box 3000 may be disposed in front of the tub body 310 to allow the user to easily put the detergent into the detergent box 3000.

The water supply portion 700 may further include a supply pipe 780 connected to the water supply valve 750 and configured to supply water to at least one of the detergent box 3000 and the tub body 310.

The supply pipe 780 may include a first supply pipe 781 configured to provide the water supplied from the water supply valve 750 to the tub 300, and a second supply pipe 782 configured to provide the water supplied from the water supply valve 750 to the detergent box 3000.

In addition, the water supply portion 700 according to the present disclosure may further include a distributor configured to receive water from the water supply valve 750 and distribute the water to the first supply pipe 781 and the second supply pipe 782.

The water supply portion 700 may be disposed above the drum 500.

The drainage portion 800 may include a drain pipe 810 coupled under the tub body 310, a drain pump 820 connected to the drain pipe 810 and configured to provide power to discharge water from the tub body 310 to the outside, and a discharge pipe 830 extending from the drain pump 820 to the outside of the cabinet 100.

The drain pump 820 may be coupled and fixed to the rear surface of the drawer body 210, and at least a part of the drain pump 820 may be disposed below the tub body 310.

The driver 600 may include a stator 610 fixed to the bottom surface of the tub body 310 and configured to generate a rotating magnetic field, a rotor 620 that rotates by the rotating magnetic field of the stator 610, and a rotation shaft 630 coupled to the rotor 620 and configured to rotate the drum body 510.

The laundry treating apparatus according to the present disclosure may include a main controller 260 configured to control at least one of the water supply valve 750, the drain pump 820, the stator 610, or the control panel 230. The main controller 260 may be coupled and fixed to the rear surface of the drawer body 210.

Thus, the connection wires of the water supply valve 750, the drain pump 820, the stator 610, and the control panel 230 may be fixed in the main controller 260 with respect to the drawer 200.

The laundry treating apparatus according to the present disclosure may include extension pipes connected to the water supply pipe 740 and the discharge pipe 830 to prevent the water supply portion 700 and the drainage portion 800 from being detached from the drawer 200 even when the drawer 200 is pulled out from the cabinet 100.

In addition, the water supply pipe 740 and the discharge pipe 830 may be supported by a guide 900 to prevent the water supply pipe 740 and the discharge pipe 830 from being twisted or dislocated whenever the drawer 200 is pulled in and out through the opening 101. The structure of the guide 900 will be described later.

The laundry treating apparatus according to the present disclosure may further include a door 370 configured to open or close the inlet 323 provided in the tub cover 320. The door 370 may be configured to selectively open the inlet 323. That is, when the inlet 323 is closed, the door 370 may be configured to prevent water from being discharged from the inlet 323 to the outside.

The inlet 323 and the open surface 212 may face each other, and the area of the open surface 212 may be greater than that of the inlet 323. Accordingly, laundry may easily be pulled in and out from the drum 500 through the inlet 323.

The door 370 may be configured to rotate in the drawer body 210 or on the tub cover 320 and open and close the inlet port 323.

The door 370 may be configured to open and close the inlet 323 while sliding along the upper surface of the drawer body 210 or along the tub cover 320. For example, the door 370 may be configured to open the inlet 323 while moving backward in a state in which the inlet 323 is closed.

Accordingly, the door 370 may open and close the inlet 323 while maintaining the installed height.

FIGS. 4A and 4B show an appearance of the laundry treating apparatus according to the present disclosure.

Referring to FIG. 4A, the drawer body 210 may be drawn outside through the opening 101. The top cover 1000 may be coupled to the upper surface of the drawer body 210 to block a space between the drawer body 210 and the tub 300 from being exposed outside.

The laundry treating apparatus according to the present disclosure may include a first detergent supply portion 3000 configured to supply a detergent to the tub 300. The first detergent supply portion 3000 may be installed in front of the top cover 1000.

In addition, the laundry treating apparatus according to the present disclosure may further include a second detergent supply portion 4000 configured to supply a softener, a bleach, or another detergent to the tub 300. The second detergent supply portion 4000 may be disposed adjacent to the first detergent supply portion 3000, but may be completely separated from the first detergent supply portion 3000.

Since the laundry treating apparatus according to the present disclosure is provided as a small or auxiliary laundry treating apparatus, the volume of the cabinet 100 is limited. Accordingly, the cross-sectional area of the tub 300 needs to be maximized to secure a sufficient washing volume. Thus, the distance between the outer surface of the tub 300 and the inner surface of the drawer 200 may significantly decrease. Since the drawer 200 has a rectangular cross-section and the tub 300 has a circular cross-section, a space at each front vertex of the drawer 200 may be greater than that on the front surface of the drawer 200.

Accordingly, the first detergent supply portion 3000 may be provided on a first front side of the drawer 200, and the second detergent supply portion 4000 may be disposed on a second front side of the drawer 200.

The first detergent supply portion 3000 and the second detergent supply portion 4000 may be completely separated and spaced apart from each other, and thus the user is less likely to confuse the first detergent supply portion 3000 and the second detergent supply portion 4000.

The open surface 212 of the drawer 200 may be formed on the top cover 1000. The open surface 212 may be provided by passing through the top cover 1000.

The area of the open surface 212 may be configured to be larger than the area of the inlet 323, and the open surface 212 may be configured to expose the entirety of the inlet 323 to the outside.

The open surface 212 may be formed in a rectangular parallelepiped shape, and the inlet 323 may be formed in a circular shape. The inlet 323 may have an area capable of completely exposing the front of the drum body 510 and the filter 530. That is, the rear surface of the inlet 323 may be located behind the filter 530.

The drawer 200 may not need to be completely pulled out from the cabinet 100. This is because when the drawer 200 is completely pulled out from the cabinet 100, it may be more difficult to support the drawer 200 in the cabinet 100 and a space required to install the laundry treating apparatus may also increase.

Accordingly, the drawer 200 may be configured to be partially pulled out from the cabinet 100. For example, the drawer 200 may be pulled out from the cabinet 100 by a length between a first length that exposes all of the open surface 212 to the outside and a second length that fully pulls out the drawer 200.

When the inlet 323 is opened, a front portion of the door 370 may be exposed to the open surface 212, and in this case, the filter 530 and a rear portion of the drum body 510 may be exposed to the outside.

When the inlet 323 is opened, the door 370 may be disposed between the bottom of the top cover 1000 and the top of the tub cover 320. Accordingly, most of the door 370 may not be exposed to the outside, and a component capable of sliding the door 370 may be protected from damage or contamination.

Referring to FIG. 4B, the door 370 is pulled out while sliding between the top cover 1000 and the tub cover 320 to close the inlet 323.

When the inlet 323 is closed by the door 370, the door 370 may also cover a part of the open surface 212. A sealing member corresponding to the shape of the inlet 323 may be provided in a lower portion of the door 370, and a frame corresponding to the shape of the open surface 212 may be provided in an upper portion of the door 370.

Accordingly, the user may put in laundry through the inlet 323, close the inlet 323 with the door 370, and insert the drawer 200 into the cabinet 100. In this case, the drawer panel 220 may be configured to close the opening 101 instead of being put into the cabinet 100. The area of the drawer panel 220 may be greater than the area of the opening 101. Accordingly, the control panel 230 may be exposed to the outside, and thus the user may manipulate the control panel 230 after putting the drawer 200 into the cabinet 100.

When washing is finished, the user may open the door 370 again to take out the laundry from the inlet 323 as shown in FIG. 4A. In this case, the user may open the door 370 to dry the tub 300 and let the drawer 200 be pulled out from the cabinet 100.

However, the door 370 of the laundry treating apparatus according to the present disclosure is configured to open and close the inlet 323 while sliding between the top cover 1000 and the tub cover 320. Thus, the drawer 200 may be put into the cabinet 100 while the inlet 323 is opened by the door 370.

In other words, even if the drawer 200 is put into the cabinet 100 in the state as shown in FIG. 4A, the door 370 may not be caught by the opening 101. Thus, the drawer 200 may be put into the cabinet 100 while the inlet 323 is opened.

In the laundry treating apparatus according to the present disclosure, the tub 300 may be dried by discharging moisture inside the tub 300 within the cabinet 100 to the inlet 323. In this case, since the bottom surface of the cabinet 100 may be penetrated, the moisture may be discharged out of the cabinet 100. As a result, the user does not need to pull out the drawer 200 from the cabinet 100 in order to dry the tub 300. Therefore, while the tub 300 dries, the drawer 200 may not obstruct the passage of the user, may not occupy a space in which the cabinet 100 is disposed, or may not generate a rotation moment in the cabinet 100.

FIG. 5 shows in detail an internal structure of the laundry treating apparatus according to the present disclosure.

Both side surfaces of the drawer body 210 may be spaced apart from the inner surface of the cabinet 100 by a predetermined distance. Rails 240 may be installed on the side surfaces of the drawer body 210 and the inner surface of the cabinet 100 to guide the drawer 200 to and from the cabinet 100.

The rails 240 may be coupled to the side surfaces of the drawer body 210 and the inner surface of the cabinet 100 so as to slide forward or backward. The rails 240 may support the load of the drawer 200 in the cabinet 100.

The rail 240 may be a two-stage rail or a three-stage rail.

The drawer 200 may have a front surface 211 on which the drawer panel 220 is coupled in front of the drawer body 210. The front surface 211 may further include limiting plates 2111 that extend to the outside further than side front ends of the drawer body 210. The limiting plates 2111 may be configured to cover gaps between the inner surface of the cabinet 100 and the side surfaces of the drawer body 210. The limiting plate 2111 may extend from the front surface of the drawer body 210 to face the inner surface of the cabinet 100.

A locking portion configured to restrict sliding of the drawer 200 when the drawer 200 is inserted into the cabinet 100 may be installed on the front surface 211.

The locking portion may include a transfer part capable of reciprocating on the front surface 211 and a fastening part detachably coupled to the inner surface of the cabinet 100 due to the reciprocating movement of the transfer part. The transfer part may be driven by received power, and the fastening part may be defined as a bar where a first end is coupled to the transfer part and a second end is retractable into a coupling groove disposed on the inner surface of the cabinet 100.

The front surface 211 may include an installation part 2113 configured to accommodate the transfer part, and protrusions 2112 provided at both ends of the installation part 2113 and configured to support the fastening part.

The protrusion 2112 may protrude outward from the front surface 211 than the installation part 2113. As a result, the distance between the front surface 211 and the tub body 310 may be extended so that a process of installing or arranging each component may become simplified.

The protrusions 2112 may be provided at the sides of the installation part 2113. In addition, a slit 2114 configured to support the fastening part may be provided in the protrusion 2112 through penetration. In addition, the slit 2114 may enhance the rigidity of the protrusion 2112 and discharge heat generated by the tub 300 to the outside.

The protrusion 2112 may buffer the impact applied to the drawer panel 220 and transmit the impact to the drawer body 210. A plurality of slits 2114 may be provided such that the slots 2114 are spaced apart from each other in the height direction.

Drawer brackets 410 may be provided at the vertices of the drawer body 210. Some drawer bracket 410 may be configured to be detachable from the drawer body 210. For example, a drawer bracket 410 disposed in front of the tub 300 may be detached from the drawer body 210, and a drawer bracket 410 disposed at the rear of the tub 200 may be integrated with the drawer body 210. Accordingly, the user may easily install the supporter 400.

The tub 300 may include an injection pipe 330 configured to guide the water and detergents supplied from the first detergent supply portion 3000 and the second detergent supply portion 4000 to the tub body 310. The injection pipe 330 may be provided in the tub body 310 and may extend from the tub body 310 to the outside. The injection pipe 330 may be skewed toward the top of the tub body 310 so as to prevent the water in the tub 300 from flowing back to the injection pipe 330.

The tub cover 320 may be coupled above the tub body 310 to support sliding of the door 370. The tub cover 320 may include a door guide 321 configured to guide the sliding of the door 370. The door guide 321 may extend from the rear of the inlet 323 toward the rear of the tub cover 320. The door 370 may be coupled to the door guide 321 such that the sliding of the door 370 is allowed.

The tub cover 320 may include a support guide 322 configured to support both side surfaces of the door 370 on both side surface of the inlet 323 to allow the sliding of the door 370. The support guides 322 may support the side surfaces of the door 370 to prevent the angle thereof from changing when the door 370 moves along the door guide 321. Thus, even if the door 370 slides multiple times, the door 370 may be disposed to close the inlet 323 at the correct position.

The tub cover 320 may further include a gasket 325 configured to reinforce a coupling force between the door 370 and the inlet 323 and support the door 370.

The gasket 325 may include a through hole corresponding to the inlet 323 and may be coupled above the tub cover 320. The gasket 325 may be manufactured separately from the tub cover 320 so that structures capable of supporting the sliding of the door 370 may be easily formed.

The gasket 325 may be made of a different material from that of the tub cover 320. The gasket 325 may have elasticity to increase the coupling force between the door 370 and the inlet 323. The gasket 325 may be configured to fix the door 370 when the door 370 is seated on the inlet 323.

The door 370 may include a door frame 371 seated on the gasket 325 and configured to slide along the door guide 321 and the support guide 322, a transparent part 373 provided inside the door frame 371 and configured to expose the inside of the drum 500 to the outside, and a handle 372 provided in front of the door frame 371.

The handle 372 may include a hook coupled to the gasket 325 in a lower portion thereof and may be configured to rotate on the door frame 371. When the handle 372 is coupled to the gasket 325, the door 370 may be fixed to top of the tub cover 320.

The tub cover 320 may include a water supply port 324 configured to receive water from the water supply portion 700. The water supply port 324 may be provided separately from the injection pipe 330 so that water may be directly supplied to the tub 300 without passing through the detergent box 3000. The water supply port 324 may be disposed on a side surface of the tub cover 320 rather than the upper surface of the tub cover 320. Such a configuration may not only prevent laundry in the drum 500 from blocking the water supply port 324 but also prevent unnecessary water supply pipes from being disposed above the tub cover 320.

Since no water supply pipes are connected above the tub cover 320, the door 370 may slide freely without any collisions with the water supply pipe 740.

The tub cover 320 may further include an air flow pipe 326 configured to adjust the pressure inside the tub 300 by connecting the inside of the tub 300 to the outside of the tub 300. Thus, even if the pressure inside the tub body 310 increases or decreases when the inlet 323 is sealed by the door 370, the pressure of the tub body 310 may be maintained equal to the outside pressure, thereby preventing the tub body 310 from being crushed or the door 370 from being randomly opened or not being opened.

The air flow pipe 326 may also be disposed on the side surface of the tub cover 320 to prevent interference with the door 370, thereby preventing water contained in the tub body 310 from flowing back to the air flow pipe 326.

The drain pump 820 may be disposed outside the drawer body 210 and fixed to the rear surface of the drawer body 210. The drain pipe 810 may extend from a lower portion of the tub body 210 and be connected to the drain pump 820 through the drawer body 210.

The guide 900 may be configured to support the discharge pipe 830 and the water supply pipe 740 on the rear surface of the drawer body 210.

The guide 900 may include a first body 910 rotatably provided on the rear surface of the cabinet 100 and a second body 920 rotatably coupled to the rear surface of the drawer body 210.

At least one of the first body 910 and the second body 920 may be configured to support the water supply pipe 740 and the discharge pipe 830.

When the drawer 200 is accommodated in the cabinet 100, the first body 910 and the second body 920 are arranged parallel to each other. When the drawer 200 is pulled out from the cabinet 100, a free end of the first body 910 may be distant from a free end of the second body 920.

As a result, while the above process is repeated, the first body 910 and the second body 920 may always move along a predetermined path between the rear surface of the drawer body 210 and the rear surface of the cabinet 100. Thus, the first body 910 and the second body 920 may support the water supply pipe 740 and the discharge pipe 830. That is, the first body 910 and the second body 920 may prevent the water supply pipe 740 and the discharge pipe 830 from vibrating excessively or hanging downward while water moves through the water supply pipe 740 and the discharge pipe 830. In addition, the first body 910 and the second body 920 may prevent the water supply pipe 740 and the discharge pipe 830 from being twisted.

The main controller 260 may be coupled to the rear surface of the drawer body 210. The main controller 260 may be coupled and fixed to the rear surface of the drawer body 210 by an extra coupling member.

The first body 910 may be disposed above the main controller 260, and the second body 920 may be disposed below the main controller 260. The main controller 260 may be configured to support the loads of the first body 910 and the second body 920 to increase a coupling force therebetween. To this end, the main controller 260 may further include a coupling bar coupled to the first body 910 and the second body 920. The structure of the coupling bar will be described later.

In the laundry treating apparatus according to the present disclosure, the top cover 1000 may be coupled above the drawer body 210. The top cover 1000 may be coupled above the drawer body 210 so that the top cover 1000 may form the upper surface of the drawer 200. Thus, it is possible to prevent a space between the tub 300 and the drawer 200 from being exposed to the outside.

The top cover 1000 may be configured to receive a first detergent and a second detergent from the first detergent supply portion 3000 and the second detergent supply portion 4000, respectively.

In addition, a part of the supply pipe 780 configured to supply water to the first detergent supply portion 3000 and the second detergent supply portion 4000 may be installed in the top cover 1000.

The top cover 1000 may be configured to support at least one of the first detergent supply portion 3000, the second detergent supply portion 4000, and the supply pipe 780. Specifically, a space for installing the first detergent supply portion 3000, the second detergent supply portion 4000, and the supply pipe 780 may be provided on the upper surface of the top cover 1000.

Accordingly, it is possible to prevent the first detergent supply portion 3000, the second detergent supply portion 4000, and the supply pipe 780 from being exposed to the inside of the drawer body 210.

When the first detergent supply portion 3000 and the second detergent supply portion 4000 are provided in the form of a detergent box capable of storing a detergent, the top cover 1000 may provide a space for not only supporting the first detergent supply portion 3000 and the second detergent supply portion 4000 but also accommodating the first detergent supply portion 3000 and the second detergent supply portion 4000.

The top cover 1000 may include a junction duct 1150 through which the first detergent and the second detergent are supplied from the first detergent supply portion 3000 and the second detergent supply portion 4000.

In addition, the junction duct 1150 may be configured to connect the first detergent supply portion 3000 and the second detergent supply portion 4000. The junction duct 1150 may be provided as a flow path for receiving and containing water supplied from the first detergent supply portion 3000 and water supplied from the second detergent supply portion 4000.

In other words, the top cover 1000 may include the junction duct 1150 to receive water from the water supply portion 700 and store the water temporarily. In addition, the top cover 1000 may be configured to receive detergents from the first detergent supply portion 3000 and the second detergent supply portion 4000 and store the detergents temporarily.

When excessive water is supplied from the first detergent supply portion 3000 and the second detergent supply portion 4000, the junction duct 1150 may contain all of the water or detergents and thus prevent overflow out of the top cover 1000.

When each of the first detergent supply portion 3000 and the second detergent supply portion 4000 is provided as a detergent box, the junction duct 1150 may expand the volume of a detergent housing that accommodates the detergent box.

The junction duct 1150 may be connected to the tub 300 so that the junction duct 1150 may supply all of the water and detergents to the tub 300. In this case, the junction duct 1150 may be disposed along the front of the drawer body 210.

The laundry treating apparatus according to the present disclosure may further include an auxiliary cover 2000 coupled to the top cover 1000 and configured to prevent at least one of the junction duct 1150, the supply pipe 780, the first detergent supply portion 3000, and the second detergent supply portion 4000 from being exposed to the outside.

The auxiliary cover 2000 may be formed in a plate shape and may include a see-through hole 2110 configured to expose the inlet 323 or the door 370 to the outside.

The first detergent supply portion 3000 may include all components for supplying the first detergent to the top cover 1000 or the junction duct 1150, and the second detergent supply portion may include all components for supplying the second detergent to the top cover 1000 or the junction duct 1150.

Accordingly, the first detergent supply portion 3000 may include a first detergent injection hole 3110 penetrating the auxiliary cover 2000 and configured to receive the first detergent. The second detergent supply portion 4000 may include a second detergent injection hole 4110 penetrating the auxiliary cover 2000 and configured to receive the second detergent.

In other words, since the top cover 1000 includes the laminate duct 1150 configured to hold the first detergent and the second detergent, at least one of the first detergent supply portion 3000 and the second detergent supply portion 4000 may not include a detergent box for holding or storing the first or second detergent. The at least one of the first detergent supply portion 3000 and the second detergent supply portion 4000 may be provided as an injection hole through which the first or second detergent is injected into the junction duct 1150.

Accordingly, each of the first detergent supply portion 3000 and the second detergent supply portion 4000 may have a simple structure.

The first detergent supply portion 3000 may further include a detergent housing such as a detergent box put into and out of the first detergent injection hole 3110 and configured to store the first detergent. The second detergent supply portion 4000 may further include a detergent housing 4200 such as a detergent box put into and out of the second detergent injection hole 4110 and configured to store the second detergent.

The width of the junction duct 1150 is much greater than the width of the first detergent supply portion 3000 and the width of the second detergent supply portion 4000, so that the junction duct 1150 may act as a space for accommodating the first detergent supply portion 3000 and the second detergent supply portion 4000.

The first detergent injection hole 3110 may have a shape corresponding to the cross section of the first detergent supply portion 3000, and the second detergent injection hole 4110 may have a shape corresponding to the cross section of the second detergent supply portion 4000. Thus, the positions of the first detergent supply portion 3000 and the second detergent supply portion 4000 may be fixed within the junction duct 1150.

The auxiliary cover 2000 may cover the upper surface of the junction duct 1150 to prevent water in the junction duct 1150 from flowing out of the junction duct 1150. In addition, the auxiliary cover 2000 may be made of a more rigid material than the top cover 1000 to prevent the top cover 1000 or the supply pipe 780 from being damaged by external impacts.

Thus, the top cover 1000 may be made of an easily processable material such as a resin-based material, and thus a structure for mounting the junction duct 1150 or the supply pipe 780 may be installed therein.

Figure 6:
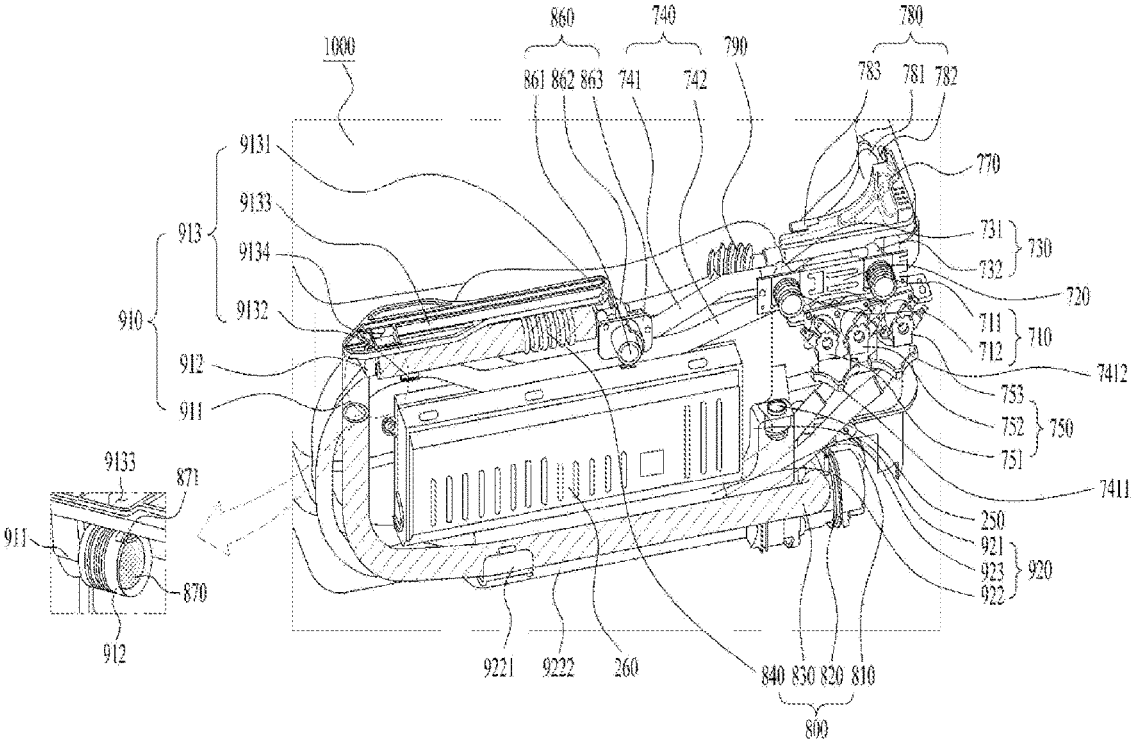
FIG. 6 shows a water supply structure of the laundry treating apparatus according to the present disclosure.

FIG. 6 shows an embodiment of a water supply and drainage structure of the laundry treating apparatus according to the present disclosure.

The water supply valve 750 may be coupled to the rear surface of the drawer body 210, and the water supply connector 710 may be coupled to the rear surface of the cabinet 100. Thus, the water supply pipe 740 may extend from the water supply valve 750 to the water supply connector 710.

Meanwhile, a plurality of water supply valve 750 may be provided to control water supplied to the first detergent supply portion 3000, the second detergent supply portion 4000, and the tub 300. In addition, the water supply valve 750 may be configured to separately provide hot water and cold water to the first detergent supply portion 3000, the second detergent supply portion 4000, and the tub 300.

Thus, the main controller 260 may control the water supply valve 750 to determine which one of the first detergent supply portion 3000, the second detergent supply portion 4000, and the tub 300 is supplied with water.

In addition, the main controller 260 may control the water supply valve 750 to determine whether to supply hot water or cold water to the first detergent supply portion 3000, the second detergent supply portion 4000, and the tub 300.

A detergent for removing foreign substances from laundry during washing may be injected into the first detergent supply portion 3000, and a bleach for bleaching laundry or a fabric softener for softening the condition of laundry or supplying fragrance thereto may be injected into the second detergent supply portion 4000.

In this case, it may be most efficient to supply all of the detergent at the beginning of the washing, and the bleach or fabric softener is supplied during rinsing. Accordingly, time points at which water is supplied to the first detergent supply portion 3000 and the second detergent supply portion 4000 may need to be controlled separately.

Therefore, the laundry treating apparatus according to the present disclosure may have multiple water supply valves 750: a water supply valve 750 configured to supply water to the first detergent supply portion 3000; and a water supply valve 750 configured to supply water to the second detergent supply portion 4000.

When a detergent is added to the first detergent supply portion 3000, all the detergent may be supplied to the tub 300 during initial water supply. Thus, even if water is supplied to the first detergent supply portion 300, the tub 300 may receive clean water. That is, the tub 300 may be configured to receive water through the first detergent supply portion 300.

Accordingly, two water supply valves 750 may be separately provided to supply water to the first detergent supply portion 3000 and a direct water supply pipe 781. Alternatively, one water supply valve 750 may be shared.

Since the second detergent supply portion 4000 is controlled to receive water during the rinsing, hot water may not need to be supplied. On the other hand, since the first detergent supply portion 3000 is controlled to receive water during the washing, hot water may be supplied depending on washing courses.

In addition, if the tub 300 is configured to receive water only through the first detergent supply portion 3000, the time required to supply water to the tub 300 may increase. This is because since the volume of the first detergent supply portion 3000 or the capacity of the junction duct 1150 is relatively small, a considerable amount of time is required to provide a large amount of water corresponding to the washing level of the tub 300 only through the first detergent supply portion 3000 and the junction duct 1150. Therefore, the laundry treating apparatus according to the present disclosure may not only include a supply pipe 782 configured to supply water from the water supply valve 750 to the first detergent supply portion 3000 but also include the direct water supply pipe 781 configured to directly supply water to the tub 300.

In summary, the water supply valve 750 of the laundry treating apparatus according to the present disclosure may include a first valve 751 and a second valve 752 configured to supply cold water, and a third valve 753 configured to supply hot water.

The first valve 751 may be configured to supply water to the second detergent supply portion 4000, and the second valve 752 may be configured to supply water to the first detergent supply portion 3000 and the tub 300. The third valve 753 may be configured to supply hot water to the first detergent supply portion 3000 and the tub 300.

The water supply pipe 740 may include a cold water pipe 741 and a hot water pipe 742. The cold water pipe 741 may be configured to supply water to the first valve 751 and the second valve 752, and the hot water pipe 742 may be configured to supply water to the third valve 753.

The cold water pipe 741 may include a cold water coupling portion 7411 coupled to the first valve 751 and the second valve 752, and the hot water pipe 742 may include a hot water coupling portion 7412 coupled to the third valve 753.

The water supply connector 710 configured to supply water to the water supply pipe 740 may be provided on the rear surface of the cabinet 100. The water supply connector 710 may include a first connector 711 configured to supply water to the cold water pipe 741 and a second connector 712 configured to supply water to the hot water pipe 742. The first connector 711 and the second connector 712 may be formed in the shape of a pipe protruding from the rear surface of the cabinet 100.

The water supply portion 700 may include a support bracket 720 configured to fix the water supply connector 710 to the rear surface of the cabinet 100.

The support bracket 720 may be formed in a plate shape. The first connector 711 and the second connector 712 may extend on one surface of the support bracket 720, and a connection pipe 730 configured to connect the first connector 711 and the second connector 712 may be included on the other surface of the support bracket 720. The connection pipe 730 may include a first connection pipe 731 extending from the support bracket 720 and coupled to the cold water pipe 741, and a second connection pipe 732 extending from the support bracket 720 and coupled to the hot water pipe 742.

The length of the water supply pipe 740 may be longer than the distance between the drawer 200 and the cabinet 100 in consideration of the sliding length of the drawer 200. The water supply valve 750 and the water supply connector 710 may be arranged to be biased toward a first side with respect to both sides of the drawer body 210. The water supply pipe 740 does not extend directly from the water supply valve 750 toward the water supply connector 710, but extends to a second side in the width direction of the drawer body 210 and then extends to the first side again. In this case, the first connection pipe 731 and the second connection pipe 732 may extend from the support bracket 720 toward the first side of the drawer body 210 to prevent the end of the water supply pipe 740 from bending toward the cabinet 100.

The drainage portion 800 may include a discharge pipe 830 configured to discharge water from the drain pump 820 to the rear surface of the cabinet 100. The drain pump 820 may be disposed under the rear surface of the drawer body 210. The drain pump 820 may be arranged to be biased to one of the sides of the drawer body 210. In addition, the water supply valve 750 and the water supply connector 710 may be arranged closer to one of the sides of the drawer body 210, which is closer to the drain pump 820. As a result, the water supply pipe 740 and the discharge pipe 830 move along the rear surface of the drawer body 210, thereby securing a sufficient sliding length.

Since the discharge pipe 830 receives power from the drain pump 820, there may be significant vibration. Accordingly, the second body 920 may support the discharge pipe 830 to be rotatable in the drain pump 820. Thus, even if the discharge pipe 830 vibrates or has a strong impact, the position of the discharge pipe 830 may be prevented from being changed or twisted.

A second guide 920 may be configured to rotate on a guide coupling part 250 provided on the rear surface of the drawer body 210. The guide coupling part 250 may protrude from the rear surface of the drawer body 210.

The second guide 920 may include a fixing link 921 rotatably coupled to the guide coupling part 250, and a holder body 922 extending from the fixing link 921 and configured to support a discharge pipe 930.

The guide coupling part 250 may be provided on one side on the rear surface of the drawer body 21, which is close to the drain pump 820, and the holder body 922 may extend from the guide coupling part 250 in a direction away from the drain pump 820.

The holder body 922 may include a main plate 9222 defining the main body thereof and extending in the length direction of the discharge pipe 830 and a drain hook 9221 protruding from the main plate 9222 and configured to detachably support the discharge pipe 830.

The drain hook 9221 may protrude from the main plate 9222 toward the cabinet 100 and also protrude close to a free end of the main plate 9222.

The second body 920 may further include an avoidance body 923 extending downward from the fixed link 921 and configured to dispose the holder body 922 under the main controller 260. The fixed link 921 may be disposed on a side surface of the main controller 260, and the holder body 922 may be disposed under the main controller 260 due to the avoidance body 923.

Meanwhile, the holder body 922 may rotatably support the water supply pipe 740 as well.

Referring to FIG. 5, the holder body 922 may include a main rib 9223 extending from the main plate 9222. The water supply pipe 740 may be fixed to the upper surface or lower surface of the main rib 9223.

The main rib 9223 may include auxiliary hooks for detachably fixing the water supply pipe 740.

The holder body 922 may include a first auxiliary rib 9244 that protrudes from the top of the main rib 9223 by being spaced apart from the main plate 9222 and is configured to support any one of the first water supply pipe 741 and the second water supply pipe 742, and a second auxiliary rib 9246 that protrudes from the bottom of the main rib 9223 on the main plate 9222 and is configured to support the other of the first water supply pipe 741 and the second water supply pipe 742.

The first water supply pipe 741 and the second water supply pipe 742 may be forcibly fitted between the first auxiliary rib 9244, the main rib 9233, and the second auxiliary rib 9246 and then fixed.

The first auxiliary rib 9244, the main rib 9233, and the second auxiliary rib 9246 may protrude in a different direction from the drain hook 9221. For example, the first auxiliary rib 9244, the main rib 9233, and the second auxiliary rib 9246 may protrude from the main plate 9222 toward the rear surface of the drawer body 210.

The discharge pipe 830 may extend to rise along one side of the main controller 260 while being supported by the second body 920, and may be coupled to the first body 910.

A drain connector 860 configured to discharge water from the tub 300 to the outside may be provided on the rear surface of the cabinet 100. The drain connector 860 may be coupled to the rear surface of the cabinet 100 to discharge water supplied from the discharge pipe 830 to the outside of the cabinet 100.

The first body 910 may support the load of the drain connector 860 and configured to rotate. The drain connector 860 may be positioned above the main controller 260, and the first body 910 may also be positioned above the main controller 260.

The first body 910 may include a rotating plate 913 configured to support one end of the drain connector 860. The rotating plate 913 may be configured to support the discharge pipe 830 and guide the discharge pipe 830 to the drain connector 860.

However, since the drain connector 860 is located above the main controller 260 and provided closer to the drain pump 820 than the free end of the second body 920, the discharge pipe 830 may be excessively bent if the discharge pipe 830 is connected to the rotating plate 913.

Accordingly, the rotating plate 913 may include a connection pipe 911, which may be coupled to the discharge pipe 830, at the free end of the first body 910, that is, at a second end of the rotating plate 913 to which the drain connector 860 is not coupled.

The connection pipe 911 may extend downward from the second end of the rotating plate 913 and be coupled to the discharge pipe 830 so that the connection pipe 911 may receive water from the discharge pipe 830. Since the connection pipe 911 extends downward from the side surface of the main controller 260, the free end of the discharge pipe 830 may be prevented from being excessively bent toward the drain pump 820.

The first body 910 may include a valve pipe 912 extending from the second end of the connection pipe 911 in the extending direction of the rotating plate 913.

The connection pipe 911 and the valve pipe 912 may be formed in an L-shape.

The valve pipe 912 may receive water from the connection pipe 911 and flow the water into the drain connector 860.

In addition, a check valve 870 may be provided at a free end of the valve pipe 912, and a communication pipe 840 configured to connect the valve pipe 912 and the drain connector 860 may be further provided.

A first end of the communication pipe 840 may be coupled to the valve pipe 912, and a second end of the communication pipe 840 may be connected to the drain connector 860. The communication pipe 840 may be configured to rotate together with the rotating plate 913.

The check valve 870 may be provided at the free end of the valve pipe 912 to prevent water supplied to the communication pipe 840 from flowing back to the drain pump 820.

The check valve 870 may be formed in a plate shape. The check valve 870 may be configured to cover the valve pipe 912 by being coupled to a protrusion protruding from the outer surface of the valve pipe 912. The valve pipe 912 may include a step for supporting the check valve 870 on the inner circumferential surface thereof The rotating plate 913 may include a fixing hook 9132 configured to detachably support the communication pipe 840. To overcome the load or vibration applied to the connection pipe 911 and the valve pipe 912, the rotating plate 913 may include an extension portion 9134. In the extension portion 9134, a first end coupled to the connection pipe 911 and the valve pipe 912 may be thicker than a second end connected to the drain connector 860.

The rotating plate 913 may include an exposed hole 9133 in a portion corresponding to the valve pipe 912. The connection state of the check valve 870 or the communication pipe 840 may be checked by the exposed hole 9133.

The first body 910 and the second body 920 may be configured to rotate while the heights are fixed in the sliding direction of the drawer 200. In this case, the first body 910 and the second body 920 may not be directly connected to each other, but may be spaced apart from each other. The first body 910 and the second body 920 may be indirectly connected through the discharge pipe 830.

The drain connector 860 may include a coupling plate 863 coupled to the rear surface of the cabinet 100, an outlet pipe 862 protruding from the coupling plate 863 to the outside of the cabinet 100, and an inlet pipe 861 extending to the inside of the cabinet 100.

The outlet pipe 862 may be coupled to the communication pipe 840.

The water supply pipe 740 may extend from the water supply connector 710, pass through the first body 910 and the second body 920, and be coupled to the water supply valve 750.

The water supply portion 700 may include a main supply pipe 781 configured to directly provide water supplied from the water supply valve 750 to the tub 300, a first supply pipe 782 configured to provide water supplied from the water supply valve 750 to the first detergent supply portion 3000 or the junction duct 1150, and a second supply pipe 783 configured to provide water supplied from the water supply valve 750 to the second detergent supply portion 4000.

The main supply pipe 781, the first supply pipe 782, and the second supply pipe 783 may be directly connected to the water supply valve 750 to supply water.

However, in the laundry treating apparatus according to the present disclosure, since the water supply valve 750 is provided on the rear surface of the drawer body 210, and the first detergent supply portion 3000 and the second detergent supply portion 4000 are disposed in front of the drawer body 210, the water supply valve 750, the first detergent supply portion 3000, and the second detergent supply portion 4000 may have different installation locations and different heights. Therefore, it may be undesirable to directly connect the main supply pipe 781, the first supply pipe 782, and the second supply pipe 783 to the water supply valve 750, in terms of safety and structures.

Accordingly, the laundry treating apparatus according to the present disclosure may include a branch portion 770 configured to connect the main supply pipe 781, the first supply pipe 782, and the second supply pipe 783 to the water supply valve 750. The branch portion 770 may be configured to receive water from the water supply valve 750 and provide the water to the main supply pipe 781, the first supply pipe 782, and the second supply pipe 783.

The branch portion 770 may be provided on the upper surface of the drawer body 210 or the top cover 1000. That is, the branch portion 770 may be disposed in parallel with the main supply pipe 781, the first supply pipe 782, and the second supply pipe 783. Thus, the water supplied to the branch portion 770 may be smoothly supplied to the main supply pipe 781, the first supply pipe 782, and the second supply pipe 783.

The branch portion 770 may be disposed on the rear surface of the drawer body 210 or the top cover 1000. In this case, since the vertices of the drawer body 210 are most distant from the tub body 310, a large amount of internal space may be secured. Accordingly, the branch portion 770 may be disposed at a vertex of the rear surface of the drawer body 210. The branch portion 770 may be biased toward one side so as to be close to the water supply valve 750.

The branch portion 770 may be provided in the shape of a housing configured to allow outside air to pass therethrough. The branch portion 770 may be coupled to an air connection pipe 790 configured to control the pressure of the tub 300. The air connection pipe 790 may be coupled to the tub cover 320 to be connected to the branch portion 770. The tub 300 may control the internal pressure equal to the outside of the cabinet 100 while exchanging air through the air connection pipe 790 and the branch portion 770.

Figure 7:
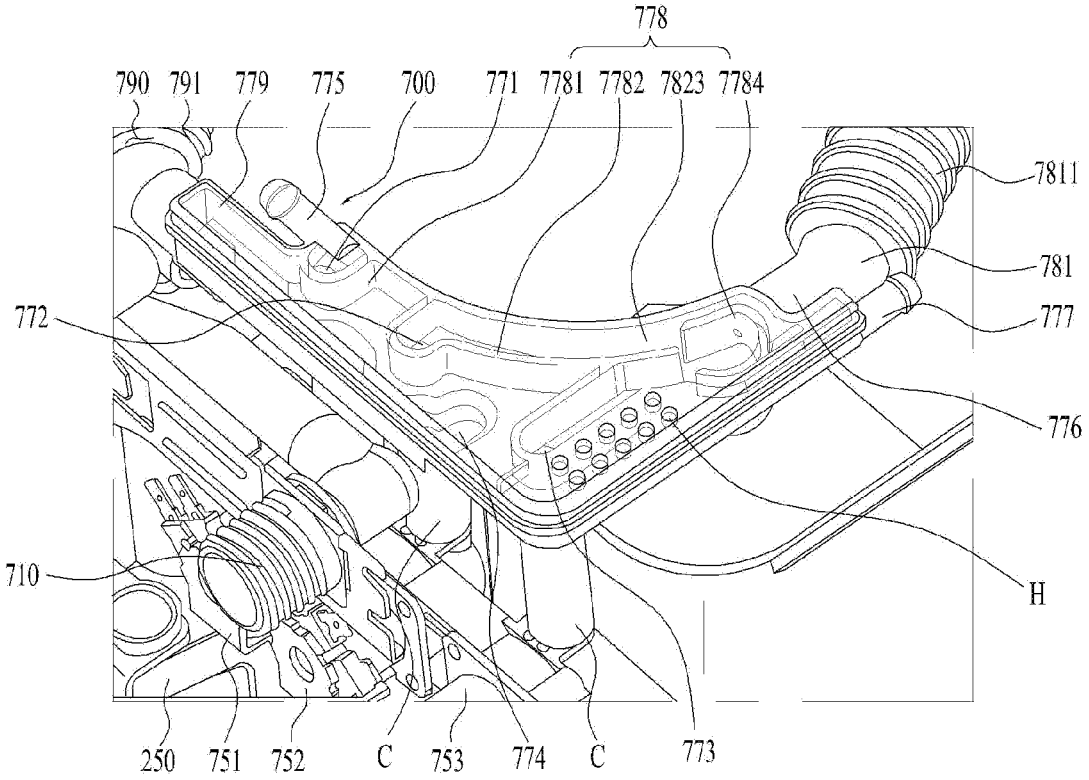
FIG. 7 shows a dispenser of the laundry treating apparatus according to the present disclosure.

FIG. 7 shows an embodiment of the branch portion 770 of the laundry treating apparatus according to the present disclosure.

The branch portion 770 may include a branch body 778 coupled above the water supply valve 750.

The branch body 778 may be provided in the shape of a housing that allows air or water to flow inside. The branch body 778 may include a ventilation hole (H) connected to the air connection pipe 790.

The branch body 778 may include a first inlet 771 configured to receive water from the first valve 751, a second inlet 772 configured to receive water from the second valve 752, and a third inlet 773 configured to receive water from the third valve 753.

The branch body 778 may include a first water supply port 775 configured to provide water supplied from the first inlet 771 to the second supply pipe 783, and a second water supply port 776 configured to provide water supplied from the second inlet 772 to the main supply pipe 781, and a third water supply port 777 configured to provide water supplied from the third inlet 773 to the first supply pipe 782.

In this case, the branch body 778 may include a first partition rib 7781 configured to separate the first inlet 771 and first water supply port 775 not only from the second inlet 772 and second water supply port 776 but also from the third inlet 773 and third water supply port 777 in the fluid phase.

The first partition rib 7781 may be configured to divide the inside of the branch body 778 into the first inlet 771 and the outside and inside of first water supply port 775. Water supplied from the first valve 771 through the first partition rib 7781 may be injected only into the first water supply port 775.

In addition, the branch body 778 may further include a partition rib for dividing the second inlet 772 and second water supply port 776 and the third inlet 773 and third water supply port 777.

However, water may be supplied to the main supply pipe 781 and the first supply pipe 782 together. That is, cold water supplied from the second valve 752 and hot water supplied from the third valve 753 may be simultaneously supplied to the main supply pipe 781 and the first supply pipe 782.

Thus, the branch body 778 may include a second partition rib 7782 configured to divide the branch body 778 into the second inlet 772, the third inlet 773, the outside and inside of the second water supply port 776, and the outside and inside of the third water supply port 777.

The second partition rib 7782 may be configured to connect the second inlet 772 and the second water supply port 776 with the third inlet 773 and the third water supply port 777 but separate the first inlet 771 and first water supply port 775 therefrom. Therefore, water may be supplied to the second detergent supply portion 4000 at an exact time.

The second partition rib 7782 may be configured to arrange the second inlet 772 and second water supply port 776 and the third inlet 773 and third water supply port 777 in a connected space. The branch body 778 may include an auxiliary partition rib 7783 configured to divide the second water supply port 776 and the third water supply port 777 at a predetermined level within the space divided by the second partition rib 7782.

Here, the division at the predetermined level may mean that a free end of the auxiliary partition rib 7783 is separated from the inner surface of the branch body 778 so that water exchange is allowed.

The auxiliary partition rib 7783 may be configured to guide the water supplied from the second inlet 772 to the second water supply port 776 or guide the water supplied from the third inlet 773 to the third water supply port 777.

A guide partition rib 7784 configured to further guide water directed to the third water supply port 777 to the second water supply port 776 may be included between the auxiliary partition rib 7783, the second water supply port 776, and the third water supply port 777. The guide partition rib 7784 may be provided as a partition wall configured to divide a space between the auxiliary partition rib 7783, the second water supply port 776, and the third water supply port 777 at a predetermined level. In addition, a through hole toward the second water supply port 776 may be provided therein.

Here, the division at the predetermined level may mean that the surface of the guide partition rib 7784 is separated from the inner surface of the branch body 778 so that water exchange is allowed.

Accordingly, most of the water flowing into the second inlet 772 and the third inlet 773 may be guided to the second water supply port 776, and only the remaining part may be guided to the third water supply port 777.

As a result, an appropriate amount of water may be supplied to the junction duct 1150 or the first detergent supply portion 3000. In other words, water may be prevented from being contained in the junction duct 1150.

In addition, the second water supply port 776 may have a larger diameter than that of the third water supply port 777.

The branch portion 770 may include a ventilation portion 779 coupled to the air connection pipe 790. The branch body 778 may have a space through which no water flows because the space is provided outside the first partition rib 7781 and the second partition rib 7782, and the space may be connected to the ventilation hole (H).

The ventilation portion 779 may also have a larger diameter than that of the first water supply port 775 so that air may flow smoothly. The air connection pipe 790 may include an air extension portion 791 that is provided as a corrugated pipe and coupled to the ventilation portion 779. The branch body 778 may also connect the part through which air flows to the drain pump 820.

Meanwhile, a plurality of connector pipes (C) configured to connect the water supply valve 750 and a lower portion of the branch portion 770 may be further included. Thus, the degree of freedom of installation of the branch portion 770 and the water supply valve 750 may be improved.

Figure 8:
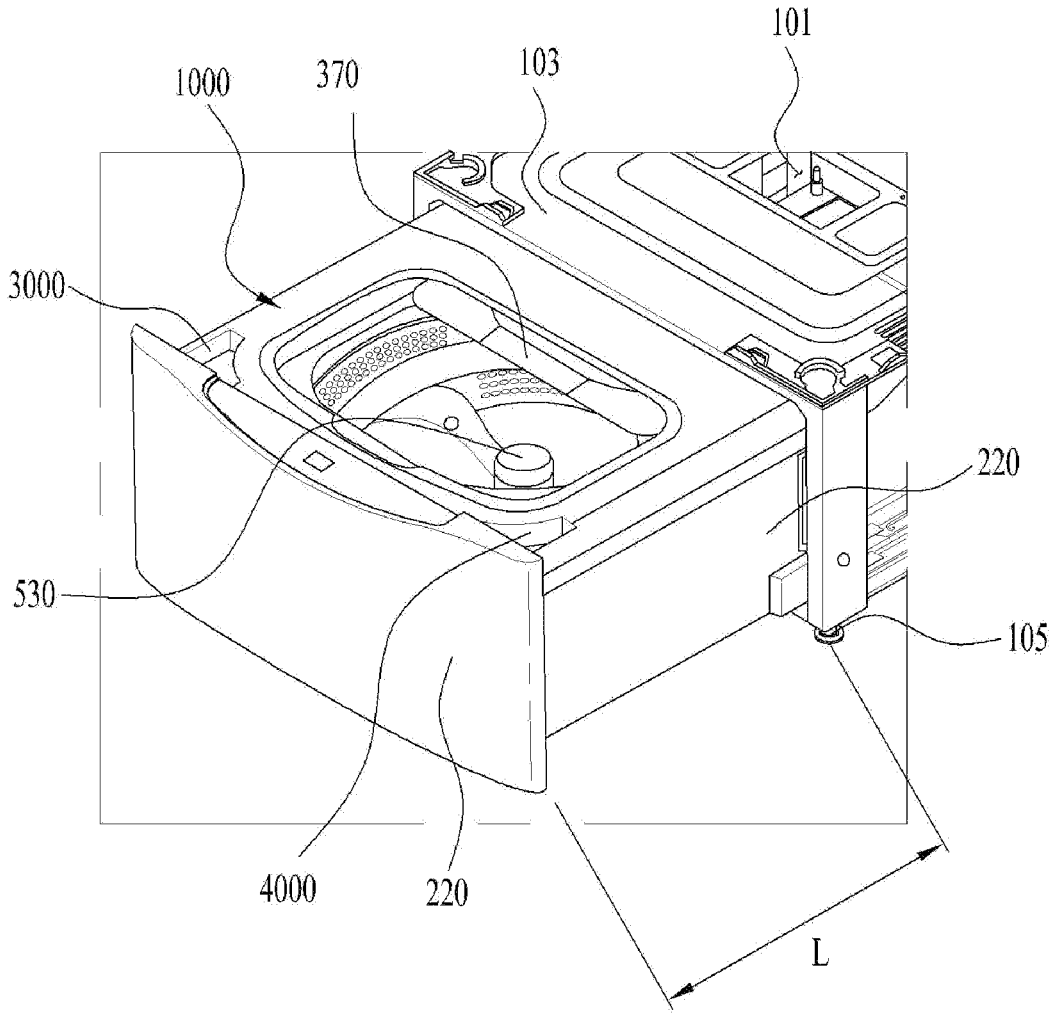
FIG. 8 shows structures of a detergent box and a top cover of the laundry treating apparatus according to the present disclosure.

FIG. 8 shows the sliding length of the drawer 200.

The cabinet 100 may include a through hole 104 in an upper panel 103 so that a buffer member may be inserted for transportation. The buffer member may be fixed to the door 370 or an upper portion of the drawer body 210 to prevent the drawer 200 from vibrating in the cabinet 100.

Legs 105 for supporting the load may be coupled to the bottom of the cabinet 100.

In the laundry treating apparatus according to the present disclosure, the drawer 200 may be partially pulled out from the cabinet 100, instead of being fully pulled out.

The drawer body 210 may be pulled out from the cabinet 100 by a sliding length (L) of a total length (L+T) corresponding to the front and rear portions of the drawer body 210. That is, the drawer body 210 may be accommodated in the cabinet 100 by an accommodation length (T). The sliding length (L) may be shorter than the accommodation length (T). Further, the sliding length (L) may be defined between a length that exposes the inlet 323 to the outside and a length that exposes all the rear surface of the drawer 200.

In this way, it is possible to prevent the drawer 200 from being completely detaching from the cabinet 100, the cabinet 100 from overturning, and the drainage portion 800 from being exposed and damaged.

As described above, the inlet 323 may extend behind the filter 530 in order to sufficiently reveal the inside of the drum 500. Thus, when the door 370 slides to open the inlet 323, the filter 530 may be exposed to the inlet 323.

The first detergent supply portion 3000 and the second detergent supply portion 4000 may be disposed in front of the tub 300 in order to increase user accessibility. In this case, the diameter of the tub 300 may be maximized to increase the washing volume. Therefore, a gap between the front of the tub 300 and the drawer body 210 may relatively decrease.

However, since the tub 300 has a circular cross section and the drawer body 210 is formed in a rectangular parallelepiped shape, a relatively large space may be provided in a portion corresponding to the vertex of the drawer body 210. Thus, the first detergent supply portion 3000 and the second detergent supply portion 4000 may be disposed on at least one of both front sides of the drawer body 210.

The first detergent supply portion 3000 and the second detergent supply portion 4000 may be arranged adjacent to each other to simply the supply pipe 780.

However, since the laundry treating apparatus according to the present disclosure is provided as a small/auxiliary laundry treating apparatus, the space between the front sides of the drawer body 210 and the tub 300 is insufficient to install the first detergent supply portion 3000 and the second detergent supply portion 4000 at the same time.

Thus, the first detergent supply portion 3000 and the second detergent supply portion 4000 may be disposed to be spaced apart from each other at the front sides or front vertices of the drawer body 210.

The control panel 230 may be disposed on the upper surface of the drawer panel 220. In this case, to prevent water and detergents supplied to the first detergent supply portion 3000 and the second detergent supply portion 4000 from overflowing to the control panel 230, the upper surface of the drawer panel 220 is higher than the upper surface of the drawer body 210.

In addition, both side surfaces of the drawer panel 220 may be wider than the front surface of the drawer body 210 to limit the sliding depth of the drawer 200.

The top cover 1000 may be coupled above the drawer body 210 to form the upper surface of the drawer 200. The top cover 1000 may be configured to fix the first detergent supply portion 3000 and the second detergent supply portion 4000 to an upper portion of the drawer body 210 and cover a space between the drawer body 210 and the tub body 310.

The total length (L+T) of the drawer body 210 may be longer than that of the top cover 1000, but only a part corresponding to the sliding length (L) may be exposed to the outside of the cabinet 100.

Figure 9:
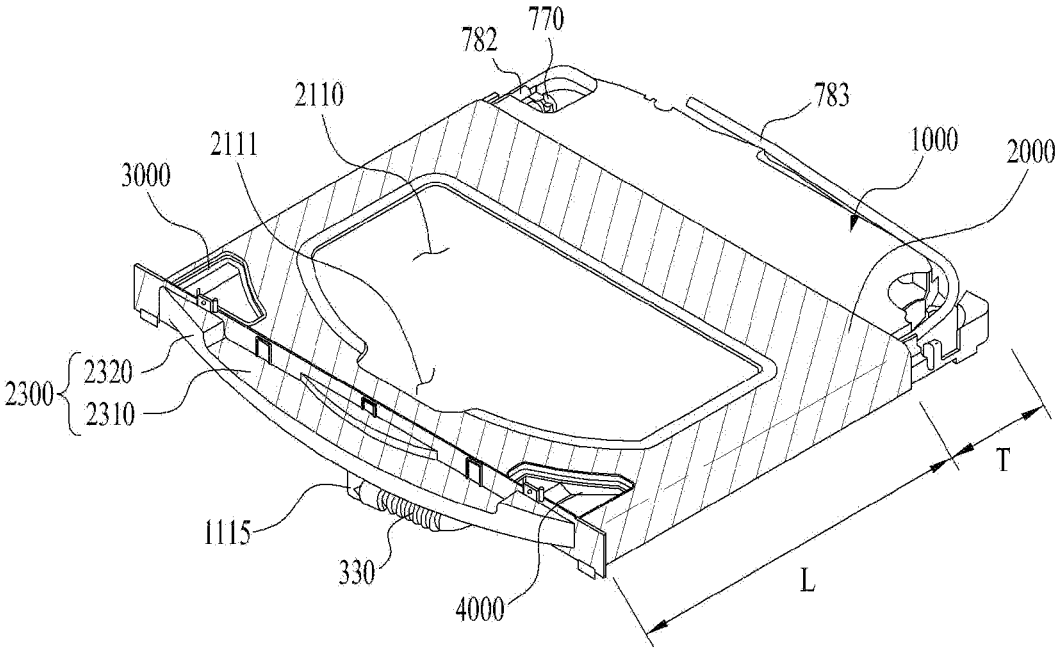
FIG. 9 shows the top cover of the laundry treating apparatus according to the present disclosure.

FIG. 9 shows a structure of the top cover 1000 of the laundry treating apparatus according to the present disclosure.

The top cover 1000 may include the junction duct 1150 and provide a space in which the first detergent supply portion 3000 and the second detergent supply portion 4000 are installed.

The main supply pipe 781, the first supply pipe 782, and the second supply pipe 783 may be accommodated or seated on the top cover 1000.

Thus, the top cover 1000 may be made of a material that is easily processed and changed. For example, the top cover 1000 may be made of a resin-based or non-metallic material.

However, if the entirety of the top cover 1000 is made of such a material easily processed and changed, the top cover 1000 may be damaged or contaminated when the user inserts or takes out laundry through the inlet 323.

Thus, the auxiliary cover 2000 may be coupled to the upper surface of the top cover 1000 to protect the top cover 1000. The auxiliary cover 2000 may be made of a more rigid material than that of the top cover 1000. For example, the auxiliary cover 2000 may be made of metal. In addition, coating may be applied to the surface of the auxiliary cover 2000 to enhance corrosion resistance.

The auxiliary cover 2000 may protect the entirety of the top cover 1000. However, when the auxiliary cover 2000 is configured to cover the entirety of the top cover 1000, material cost may increase and the total load of the drawer 200 may unnecessarily increase.

Accordingly, the auxiliary cover 2000 may have a width equivalent to the width of the top cover 100, but may have a length equal to or slightly longer than the sliding length (L). In other words, the auxiliary cover 2000 may be coupled only to an area where the top cover 1000 is exposed to the outside.

An integrated pipe 1155 configured to discharge water and detergents in the junction duct 1150 to the outside of the top cover 1000 may be provided under the top cover 1000. The integrated pipe 1155 may be disposed at the lowest position of the top cover 1000, and the integrated pipe 1155 may be coupled to a junction pipe 340 configured to supply water to the tub body 310.

The first detergent supply portion 3000 and the second detergent supply portion 4000 may be installed in the auxiliary cover 2000 or supported by the auxiliary cover 2000.

Figure 10:
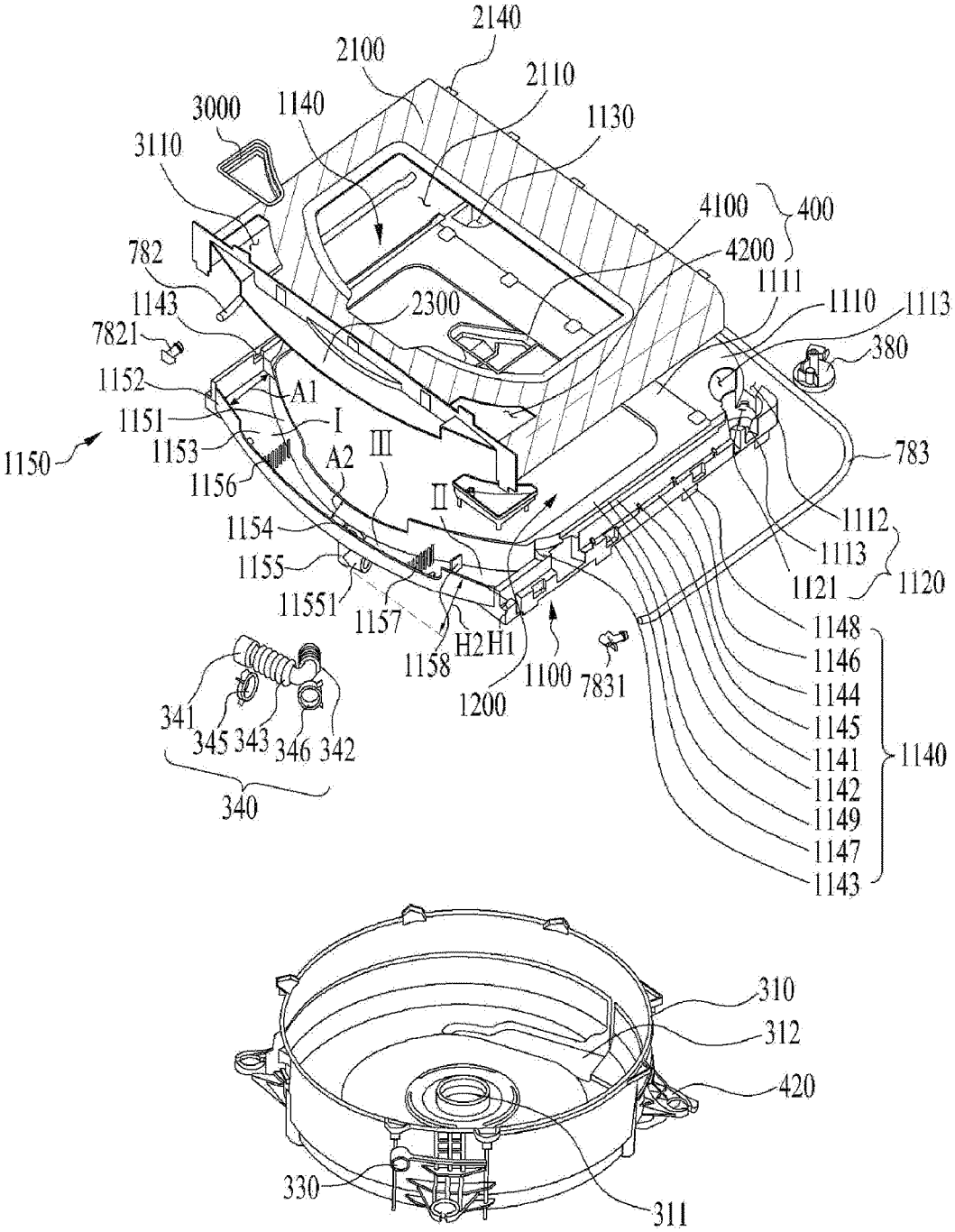
FIG. 10 shows an exploded perspective view of the top cover structure of the laundry treating apparatus according to the present disclosure.

FIG. 10 shows in detail the structures of the top cover 1000 and the auxiliary cover 2000 of the laundry treating apparatus according to the present disclosure.

The top cover 1000 may include an edge portion 1100 coupled to the upper surface of the drawer body 210 and a hole portion 1200 penetrating the edge portion 1100 and configured to expose the inlet 323 to the outside.

The edge portion 1100 may include a blocking surface 1110, an extension portion 1140, and the junction duct 1150. The blocking surface 1110 may be configured cover a space between the rear of the tub body 310 and the rear surface of the drawer body 210. The extension portion 1140 may extend from both ends of the blocking surface 1110 to the front of the drawer body 210. The junction duct 1150 may extend from both ends of the extension portion 1140 and be configured to receive the first detergent from the first detergent supply portion 3000 and the second detergent from the second detergent supply portion 4000.

A placement portion 1130 configured to provide a space for connecting the supply pipe 780 and the water supply valve 750 may be provided on a first side of the blocking surface 1110. The placement portion 1130 may be provided by cutting the blocking surface 1110 so that a first end of the supply pipe 780 may be exposed. Thus, the user may connect the first end of the supply pipe 780 to the water supply valve 750 even when the top cover 1000 is coupled above the drawer body 210. When the branch portion 770 configured to connect the water supply valve 750 and the supply pipe 780 is provided, the branch portion 770 may be exposed to the placement portion 1130. Thus, the user may connect the first end of the supply pipe 780 to the branch portion 770 to connect the supply pipe 780 to the water supply valve 750 or the water supply pipe 740.

Meanwhile, an installation portion 1120 for mounting a water level sensor 380 of the tub body 310 may be provided on a second side of the blocking surface 1110.

The installation portion 1120 may have a height lower than that of the blocking surface 1110, and may be configured to support a lower portion of the water level sensor 380.

The installation portion 1120 may include a sensor mounting groove 1121 in which the water level sensor 380 is mounted and seated. The sensor mounting groove 1121 may be provided by recessing the lower surface of the installation portion 1120, and a connection pipe for connecting the water level sensor 380 and the tub 300 may be provided by passing through the inside of the sensor receiving groove 1121.

The sensor mounting groove 1121 may be configured to correspond to the shape of the outer circumferential surface of the water level sensor 380, so that the water level sensor 380 may be inserted and seated therein.

The installation portion 1120 may include a cut groove 1122 concavely recessed from the outer circumferential surface of the sensor mounting groove 1121 and a seating groove 1123 disposed spaced apart from the cut groove 1122. .

The cut groove 1122 and the seating groove 1123 may be provided lower than the upper surface of the installation portion 1120. The cut groove 1122 and the seating groove 1123 may be penetrated by the second supply pipe 783 so that the cut groove 1122 and the seating groove 1123 may be fixed. The cut groove 1122 may be provided in a part of the outer circumferential surface of the sensor mounting groove 1121, which faces the rear surface of the drawer body 210. The second supply pipe 783 may extend from the branch portion 770 along the rear surface of the drawer body 210 and then be inserted into the cut groove 1122 so as to be fixed to the extension portion 1140.

The seating groove 1123 may be provided in a part of the sensor mounting groove 1121 facing a side surface of the drawer body 210. The second supply pipe 783 may be disposed in the seating groove 1123, and the seating groove 1123 may be coupled to a part of the outer circumferential surface of the water level sensor 380.

A through hole 1113 configured to expose the inside of the drawer body 210 may be provided between the blocking surface 1110 and the installation portion 1120 by cutting. A state in which the water level sensor 380 and the tub body 310 are connected may be checked by the through hole 1113.

The blocking surface 1110, the installation portion 1120, and the placement portion 1130 may define the rear of the top cover 1000.

The first supply pipe 782 may extend from the water supply valve 750 or the branch portion 770 toward the first detergent supply portion 3000, and the second supply pipe 783 may extend from the water supply valve 750 or the branch portion 770 toward the second detergent supply portion 4000.

The first supply pipe 782 may include a first nozzle 7821 configured to supply water to the first detergent supply portion 3000 or the junction duct 1150. The second supply pipe 783 may include a second nozzle 7831 configured to supply water to the second three box 4000 or the junction duct 1150.

The connection portion 1140 may extend forward from the installation portion 1120 and the placement portion 1130 to define a side surface of the top cover 1000.

The connection portion 1140 may include a guide groove 1141 in which the first supply pipe 782 or the second supply pipe 783 is seated. The guide groove 1141 may be defined by recessing an upper portion of the connection portion 1140 and extending the recess in the length direction of the connection portion 1140.

The guide groove 1141 may have a width corresponding to the diameter of the first supply pipe 782 or the second supply pipe 783. The guide groove 1141 may include a fixing hook 1142 configured to fix a part of the upper surface of the first supply pipe 782 or the second supply pipe 783 on the upper surface thereof. The fixing hook 1142 may extend from an upper portion of the guide groove 1141 such that the guide groove 1141 has an open surface having a width smaller than the maximum diameter of the guide groove 1141. Thus, the first supply pipe 782 or the second supply pipe 783 may be forcibly fitted into the fixing hook 1142 and then be seated in and fixed to the guide groove 1141.

A nozzle mounting portion 1143 in which the first nozzle 7821 and the second nozzle 7831 are coupled to the ends of the first supply pipe 782 and the second supply pipe 783, respectively may be provided in front of the connection portion 1140. The nozzle mounting portion 1143 may be configured to be detachably coupled to a lower portion of the nozzle so that the nozzle may be fixed.

The nozzle mounting portion 1143 may be provided at a point where the junction duct 1150 and the connection portion 1140 are connected, and may be formed in a groove shape that communicates the junction duct 1150 and the guide groove 1141. The first nozzle 7821 and the second nozzle 7831 may be mounted on the nozzle mounting portion 1143 and fixed in positions.

The first supply pipe 782 or the second supply pipe 783 may extend from the water supply valve 750 or the branch portion 770 to the nozzle mounting portion 1143 while being fixed to the guide groove 1141.

The connection portion 1140 may include a coupling step 1144 extending stepwise from the guide groove 1141 toward the outer surface thereof and an exposed side surface 1146 extending downward from the coupling step 1144 and coupled to the drawer body 210. The exposed side surface 1146 may define the side surface of the top cover 1000 exposed to the outside.

The height of the coupling step 1144 may be smaller than the height of the guide groove 1141. Both sides of the auxiliary cover 2000 may be seated in and fixed to the coupling step 1144.

A coupling hook 1145 may be provided. The coupling hook 1145 may extend upward from the lower surface of the coupling step 1144 and be coupled to the auxiliary cover 2000. The coupling hook 1145 may protrude from the upper surface of the coupling step 1144 or the exposed side surface 1146. A plurality of coupling hooks 1145 may be provided by being spaced from each other in the length direction of the connection portion 1140. The coupling hook 1145 may be detachably coupled to the inner surface of the auxiliary cover 2000 to fix the auxiliary cover 2000 to the top of the top cover 1000.

The exposed side surface 1146 may include a separation groove 1147 that is recessed toward the coupling step 1144. The separation groove 1147 may be defined such that an upper portion of the separation groove 1147 faces the lower surface of the auxiliary cover 2000 and the separation groove 1147 has a depth sufficient to allow the user to put a finger in.

The user may separate the auxiliary cover 2000 from the top cover 1000 through the separation groove 1147.

A separation preventing protrusion 1148 coupled to the upper surface of the drawer body 210 may be provided on the lower surface of the connection portion 1140. The separation preventing protrusion 1148 may be detachably coupled to an upper portion of the drawer body 210. The separation preventing protrusion 1148 may extend from a lower portion of the exposed side surface 1146 and be spaced apart by a predetermined distance in the length direction of the connection portion 1140. The separation preventing protrusion 1148 may have a width longer than that of the coupling hook 1145.

The separation preventing protrusion 1148 may configured to detachably couple the top cover 1000 to the top of the drawer body 210.

The connection portion 1140 may support and mount the first supply pipe 782 and the second supply pipe 783. That is, the connection portion 1140 may provide a space for supporting the bottoms of the first supply pipe 782 and the second supply pipe 783, so that the first supply pipe 782 and the second supply pipe 783 may be prevented from being exposed to the inside of the drawer body 210 or the side surface of the drawer body 210.

The junction duct 1150 may be provided in front of the top cover 1000. Specifically, the junction duct 1150 may be provided in front of the connection portion 1140 and define spaces for receiving the first detergent and the second detergent from the first detergent supply portion 3000 and the second detergent supply portion 4000, respectively.

If the first detergent supply portion 3000 or the second detergent supply portion 4000 is provided as a detergent box or detergent housing capable of storing a detergent, the junction duct 1150 may serve as a duct for accommodating both the first detergent supply portion 3000 and the second detergent supply portion 4000. The volume of the junction duct 1150 may be greater than the sum of the volume of the first detergent supply portion 3000 and the volume of the second detergent supply portion 4000. Thus, even if water overflows out of the first detergent supply portion 3000 and the second detergent supply portion 4000, the water may be contained in the junction duct 1150. That is, water and detergents may be prevented from overflowing out of top cover 1000.

In addition, even if the volumes of the first detergent supply portion 3000 and the second detergent supply portion 4000 are relatively small, a large amount of water may be supplied to the first detergent supply portion 3000 and the second detergent supply portion 4000 without consideration of the overflow of water out of the first detergent supply portion 3000 and the second detergent supply portion 4000. Thus, it is possible to prevent detergents from remaining in the first detergent supply portion 3000 and the second detergent supply portion 4000.

If the first detergent supply portion 3000 or the second detergent supply portion 4000 is provided as a through-hole through which a detergent is injected rather than a detergent box or detergent housing, the junction duct 1150 may serve as a duct or flow path for receiving the first and second detergents and water from the supply pipe 780 and transferring the water and detergents to the tub 300.

In this case, the junction duct 1150 has an area much larger than the area of the first detergent supply portion 3000 or the second detergent supply portion 4000, the area of a space in which the water supplied to the junction duct 1150 is contained may also be much greater than the area of the first detergent supply portion 3000 or the second detergent supply portion 4000. Accordingly, it is possible to prevent the water for delivering the detergents from overflowing out of the top cover 1000.

In addition, the junction duct 1150 may include a junction hole 1154 configured to deliver water and detergents to the tub 300. The junction duct 1150 may guide all the water and detergents supplied from the first detergent supply portion 3000 and the second detergent supply portion 4000 to the tub 300 through the junction hole 1154.

The junction duct 1150 may include a first receiving portion (I), a second receiving portion (II), and a transfer portion (III). The first receiving portion (I) may be configured to accommodate the first detergent supply portion 3000 or receive the first detergent supplied from the first detergent supply portion 3000. The second receiving portion (II) may be configured to accommodate the second detergent supply portion 4000 or receive the second detergent supplied from the second detergent supply portion 4000. The transfer portion (III) may be configured to connect the first receiving portion (I) and the second receiving portion (II).

The junction duct 1150 may be provided as an integrated duct capable of receiving both the first and second detergents rather than a housing or Y pipe that accommodates the first detergent supply portion 3000 and the second detergent supply portion 4000 separately.

When the first detergent supply portion 3000 and the second detergent supply portion 4000 are provided as detergent boxes, the junction duct 1150 may be configured to accommodate all of the detergent boxes.

When the first detergent injected from the first detergent supply portion 3000 reaches the first receiving portion (I), the first detergent may move toward the second receiving portion (II). When the second detergent injected from the second detergent supply portion 4000 reaches the second receiving portion (II), the second detergent may move toward the first receiving portion (I).

Since water is supplied to the first detergent supply portion 3000 and the second detergent supply portion 4000 at different times, the junction duct 1150 may create an effect as if the volume of a housing for containing the first or second detergent increases.

Since the first detergent supply portion 3000 is provided on a first front side of the top cover 1000 and the second detergent supply portion 4000 is provided on a second front side of the top cover 1000, the first receiving portion (I) and the second receiving portion (II) may be disposed at both ends of the junction duct 1150. As described above, the transfer portion (III) may be configured to connect the first receiving portion (I) and the second receiving portion (II).

The junction hole 1154 may be defined by penetrating the transfer portion (III). That is, the junction hole 1154 may be disposed between the first receiving portion (I) and the second receiving portion (II).

The first detergent and water supplied to the first receiving portion (I) may move toward the second receiving portion (II) along the transfer portion (III) 1153. In this process, some of the first detergent and water may be discharged to the junction hole 1154, and the rest may further move toward the second receiving portion (II) and discharged to the junction hole 1154 again.

The second detergent and water supplied to the second receiving portion (II) may move toward the first receiving portion (I) along the transfer portion (III) 1153. In this process, some of the second detergent and water may be discharged to the junction hole 1154, and the rest may further move toward the first receiving portion (I) and discharged to the junction hole 1154 again.

Even if the first receiving portion (I) and the second receiving portion (II) have areas or volumes greater than those of the first detergent supply portion 3000 and the second detergent supply portion 4000, respectively, the water, the first detergent, or the second detergent should not remain in in the junction duct 1150.

To this end, the first receiving portion (I) or the second receiving portion (II) may be disposed above the junction hole 1154.

For example, the transfer portion (III) may be defined such that the height thereof decreases from the first receiving portion (I) and the second receiving portion (II) toward the junction hole 1154. The bottom surface of the first receiving portion (I) or the bottom surface of the second receiving portion (II) may be inclined toward the junction hole 1154. Thus, the first detergent and water supplied to the first receiving portion (I) may be completely discharged to the junction hole 1154 by their own weight, and the second detergent and water supplied to the second receiving portion (II) may be completely discharged to the junction hole 1154 by their own weight.

The area of the first receiving portion (I) or the area of the second receiving portion (II) may be larger than the area of the transfer portion (III).

For example, the transfer portion (III) may be defined such that the width thereof decreases from the first receiving portion (I) and the second receiving portion (II) toward the junction hole 1154. A part of the transfer portion (III) where the junction hole 1154 is formed may have an area or width smaller than those of other portions.

Thus, as the first detergent and water delivered to the first receiving portion (I) flow into the transfer portion (III), the flow amount or rate per unit area may increase. In addition, as the second detergent and water delivered to the second receiving portion (II) flow into the transfer portion (III), the flow amount or rate per unit area may increase. As a result, the first detergent and water delivered to the first receiving portion (I) may be guided to the transfer portion (III) without remaining, and the second detergent and water delivered to the second receiving portion (II) may also be guided to the transfer portion (III) without remaining. Moreover, since the flow amount or rate per unit area further increases as the water and detergents are closer to the junction hole 1154, it is possible to prevent the water and detergents injected into the transfer portion (III) from remaining in the transfer portion (III).

The junction duct 1150 may include a first filter unit 1156 disposed between the first receiving portion (I) and the junction hole 1154 and configured to prevent foreign substances from being injected into the junction hole 1154. The first filter unit 1156 may be defined in any shape as long as it is capable of removing or filtering foreign substances contained in the first detergent and water delivered to the first receiving portion (I). For example, the first filter unit 1156 may be defined as a plurality of protrusions protruding from the transfer portion (III) in the width direction as shown in FIG. 10. Alternatively, the first filter unit 1156 may be defined as a mesh member disposed along the cross section of the transfer portion (III).

The first filter unit 1156 may be configured to seat the first detergent supply portion 3000 in the first receiving portion (I) and prevent the first detergent supply portion 3000 from moving to the transfer portion (III). In addition, one surface of the first detergent supply portion 3000 may be mounted thereon.

Meanwhile, the junction duct 1150 may include a second filter unit 1157 disposed between the second receiving portion (II) and the junction hole 1154 and configured to prevent foreign substances from being injected into the junction hole 1154. The second filter unit 1157 may be defined in any shape as long as it is capable of removing or filtering foreign substances contained in the second detergent and water delivered to the second receiving portion (II). For example, the second filter unit 1157 may be defined as a plurality of protrusions protruding from the transfer portion (III) in the width direction as shown in FIG. 10. Alternatively, the second filter unit 1157 may be defined as a mesh member disposed along the cross section of the transfer portion (III).

Meanwhile, the junction duct 1150 may also include an inner rib 1151, an outer rib 1152, and a moving rib 1153. The inner rib 1151 may face the hole portion 1200. The outer rib 1152 may be disposed in front of the inner rib 1151 and define the front surface of the top cover 1000. The moving rib 1153 may connect the inner rib 1151 and the outer rib 1152 to form a duct.

The junction hole 1154, which is connected to the tub 300, may be provided between both ends of the moving rib 1153.

The space between the drawer body 210 and tub body 310 may increase toward the front vertices of the drawer body 210. Thus, both ends of the inner rib 1151 may be farther spaced from the outer rib 1152 than the center of the inner rib 1511. A first distance (A1) between the end of the inner rib 1151 and the outer rib 1152 may be longer than a second distance (A2) between the center of the inner rib 1151 and the outer rib 1152. In addition, the inner rib 1151 may have a greater curvature than that of the outer rib 1152.

Since the first detergent supply portion 3000 and the second detergent supply portion 4000 require relatively large spaces or areas to accommodate or receive sufficient amounts of detergents, the first detergent supply portion 3000 and the second detergent supply portion 4000 may be disposed closer to the ends of the inner rib 1151 than the center of the inner rib 1151. That is, the first receiving portion (I) may be provided at one end of the inner rib 1151, and the second receiving portion (II) may be provided at the other end of the inner rib 1151.

The moving rib 1153 defining the bottom surface of the junction duct 1150 may accommodate water and detergents injected between the inner rib 1151 and the outer rib 1152. In this case, the moving rib 1153 may supply the injected water and detergents to the tub 300 through the junction hole 1154, or may temporarily move the injected water and detergents to the ends of the inner rib 1151 and outer rib 1152. Since the cross-sectional area of the moving rib 1153 is larger than those of the first detergent supply portion 3000 and the second detergent supply portion 4000, a large amount of water may be supplied to the first detergent supply portion 3000 and the second detergent supply portion 4000. In addition, even if water is supplied with a high pressure, the water may not overflow out of the junction duct 1150.

In the moving rib 1153, a height (H2) from the junction hole 1154 to the top of the inner rib 1151 or outer rib 1152 may be greater than a height (H1) from the end of moving rib 1153 to the top of the inner rib 1151 or outer rib 1152.

Since each of the inner rib 1151 and the outer rib 1152 has a constant height along the front of the top cover 1000, the junction hole 1154 may be placed lowest.

The height of the moving rib 1153 may decrease toward the junction hole 1154 from the ends thereof.

The width of the moving rib 1153 at both ends may be wider than the width of a portion in which the junction hole 1154 is defined. In addition, the area of the moving rib 1153 may decrease from the ends thereof toward the junction hole 1154.

Accordingly, water and detergents injected into the moving rib 1153 may be discharged through the junction hole 1154 without remaining in the moving rib 1153.

Both the first detergent supplied from the first detergent supply portion 3000 and the second detergent supplied from the second detergent supply portion 4000 may be discharged through the junction hole 1154. Thus, any one of the structures for connecting the first detergent supply portion 3000 and the second detergent supply portion 4000 to the tub 300 may be omitted. In other words, the production and assembly process of the laundry treating apparatus according to the present disclosure may be further simplified.

The junction hole 1154 may be connected to the tub 300 through the junction pipe 340. The junction duct 1150 may further include the integrated pipe 1155, which extends from the junction hole 1154 to the outside of the junction duct 1150, to reinforce a coupling force with the junction pipe 340. The integrated pipe 1155 may be formed in the shape of a pipe that extends from the junction duct 1150 to the outside.

The injection pipe 330 of the tub 300 may protrude from the tub body 310 so that the injection pipe 330 may be coupled to the junction pipe 340.

The junction pipe 340 may include a laminated connection pipe 341 coupled to the integrated pipe 1155 at a first end thereof and include a coupling link pipe 342 coupled to the injection pipe at a second end thereof. The laminated connection pipe 341 may be coupled to and accommodate the integrated pipe 1155, and the coupling link pipe 342 may be coupled to accommodate the injection pipe 330. The junction pipe 340 may further include a first coupling member 345 configured to couple the integrated pipe 1155 and the laminated connector 341, and a second coupling member 346 configured to couple the coupling link pipe 342 and the injection pipe 330. The first coupling member 345 and the second coupling member 346 may be provided as clamps, etc.

When vibration occurs in the tub 300, the vibration may be transmitted to the junction pipe 340. The junction pipe 340 may be made of an elastic member to absorb the vibration.

If the length of the junction pipe 340 is short, the junction pipe 340 may not properly absorb the vibration.

Thus, the length of the junction pipe 340 may need to be longer than the shortest distance between the integrated pipe 1155 and the tub body 310.

However, if the length of the junction pipe 340 is excessively elongated, a part of the junction pipe 340 is stretched below the ends thereof, and as a result, there may be residual water in the junction pipe 340.

Therefore, the junction pipe 340 may be defined such that the height of the junction pipe 340 decreases from the integrated pipe 1155 to the injection pipe 330, but the length of the junction pipe 340 needs to be longer than the shortest distance between the integrated pipe 1155 and the tub body 310.

To this end, the integrated pipe 1155 may further include an inclined pipe 11551 extending from a free end in a direction other than the tub 300. The inclined pipe 11551 may extend from the integrated pipe 1155 in a direction non-perpendicular to the ground. The inclined pipe 11551 may extend in parallel to the normal direction of the tub body 310 or may extend toward the connection portion 1140. The inclined pipe 11551 may extend along the moving rib 1153 in parallel.

Since the junction pipe 340 is extended by coupling the laminated connection pipe 341 to the inclined pipe 11551, a section that does not extend directly to the tub 300 may be secured. Thus, the length of the junction pipe 340 may further increase.

The injection pipe 330 may not face the junction duct 1150 or the integrated pipe 1155. For example, the injection pipe 330 may protrude and extend between the front surface of the tub body 310 facing the junction duct 1150 and the side surface of the tub body 310 facing the connection portion 1140.

The coupling link pipe 342 of the junction pipe 340 should extend more than the shortest distance between the tub body 310 and the integrated pipe 1155 in order to be connected to the injection pipe 330.

Therefore, the length of the junction pipe 340 may further increase.

In the junction pipe 340, the laminated connection pipe 341 may be disposed toward the moving rib 1153, and the coupling link pipe 342 may be disposed toward the injection pipe 330.

That is, the laminated connection pipe 341 and the coupling link pipe 342 may be arranged so as not to be parallel to each other.

The junction pipe 340 may further include a body pipe 343 configured to connect the laminated connection pipe 341 and the coupling link pipe 342. The main body pipe 343 may be bent and extended to the laminated connection pipe 341 and the coupling link pipe 342, and a part of the main body pipe 343 may be provided as a corrugated pipe.

Thus, when vibration occurs in the tub 300, the junction pipe 340 may serve as a buffer. As a result, the junction pipe 340, the junction duct 1150, and the tub 300 may be prevented from being separated or damaged.

The auxiliary cover 2000 may be coupled to the top cover 1000 to cover the junction duct 1150 and the connection portion 1140. The auxiliary cover 2000 may include an auxiliary body 2100 coupled above the top cover 1000 and a see-through hole 2110 connected to the hole portion 1200 by passing through the auxiliary body 2100.

The see-through hole 2110 may be formed in a shape corresponding to the hole portion 1200. An avoidance groove 2111 configured to avoid interference with the handle 372 of the door 370 may be disposed in front of the see-through hole 2110.

The auxiliary body 2100 may be configured to cover the top of the junction duct 1150 to prevent water or detergents in the junction duct 1150 from leaking to the outside, and cover the top of the connection portion 1140 to prevent the first supply pipe 782 and the second supply pipe 783 from being exposed to the outside.

In addition, the auxiliary body 2100 may be made of a more rigid material than that of the top cover 1000, and coating may be applied to the surface of the auxiliary body 2100. Thus, the shape or state of the auxiliary body 2100 may not be changed even if it comes into contact with water or laundry.

The auxiliary body 2100 may include the first detergent injection hole 3110 and the second detergent injection hole 4110 on both front sides thereof.

The first detergent injection hole 3110 may be provided above the first receiving portion (I), and the second detergent injection hole 4110 may be provided above the second receiving portion (II).

An installation plate 2300 on which the control panel 230 is mounted may be provided in front of the auxiliary body 2100.

The installation plate 2300 may be provided such that the lower surface thereof covers the tops of the inner rib 1151 and outer rib 1152.

The lower surface of the installation plate 2300 may be formed to correspond to the upper shapes of the inner rib 1151 and outer rib 1152. For example, the height of a portion in which the inner rib 1151 and outer rib 1152 are installed may be different from the height of an outer portion of the inner rib 1151 and outer rib 1152. Accordingly, the installation plate 2300 may seal the junction duct 1150 by making surface contact with the upper ends of the inner rib 1151 and outer rib 1152.

A sealing member for sealing the inner rib 1151 and outer rib 1152 may be further provided at the bottom of the auxiliary body 2100 or at the bottom of the installation plate 2300.

Meanwhile, a part of the lower surface of the installation plate 2300 that is disposed behind the inner rib 1151 and provided outside the junction duct 1150 may be used as a handle. That is, the lower surface of the installation plate 2300 disposed in front of the avoidance groove 2111 may be used as an action plate capable of receiving force that separates the auxiliary cover 2000 from the top cover 1000.

The installation plate 2300 may include an installation groove 2310 for inserting and installing the control panel 230, and a support 2320 protruding from both ends of the installation groove 2310 and configured to support the control panel 230.

The auxiliary cover 2000 may further include a separation rib 2200 configured to separate the installation plate 2300 from the first detergent injection hole 3110, the second detergent injection hole 4110, and the see-through hole 2110. The separating rib 2200 may protrude from the auxiliary body 2100 to prevent water or detergents behind the separating rib 2200 from flowing into the control panel 230.

The auxiliary cover 2000 may further include a coupling rib 2400 extending from both side surfaces of the auxiliary body 2100 and seated in the coupling step 1144.

The coupling rib 2400 may define the side surfaces of the auxiliary cover 2000, and may be detachably coupled to the coupling hook 1145. The coupling rib 2400 may have a coupling engaging portion coupled to the coupling hook 1145 on the inner surface thereof.

Meanwhile, the auxiliary cover 2000 may further include a fastening protrusion 2140 inserted into and coupled to the blocking surface 1110 of the top cover 1000.

A plurality of fastening protrusions 2140 may be provided. The plurality of fastening protrusions 2140 may be spaced apart from each other and protrude from the rear surface of the auxiliary body 2100.

The top cover 1000 may include a hook receiving groove 1112 coupled to the fastening protrusion 2140 on the blocking surface 1110.

A stepped surface 1111 may be provided in front of the hook receiving groove 1112. The stepped surface 1111 may have a height lower than that of the blocking surface 1110 to mount the auxiliary cover 2000.

The first detergent supply portion 3000 may be provided as a detergent box for storing the first detergent, and may be mounted on the top of the first receiving portion (I). In this case, the first supply pipe 782 may be coupled to the detergent box to supply water. The detergent contained in the detergent box may be dissolved in the water and discharged to the first receiving portion (I).

However, the first detergent supply portion 3000 may not need to provide the tub 300 with the first detergent that removes or separates foreign substances from laundry during the washing.

The first detergent may be injected into the tub 300 immediately when the laundry treating apparatus is operated. The washing efficiency may be maximized when the first detergent is supplied to the tub 300 as soon as water starts to be supplied to the tub 300 to be applied to laundry.

Therefore, the first detergent supply portion 3000 may include the first detergent injection hole 3110 configured to inject the first detergent directly into the junction duct 1150 or the first receiving portion (I) by passing through the auxiliary cover 2000. That is, the first detergent supplied through the first detergent injection hole 3110 may be directly injected into the first receiving portion (I). When water is supplied through the first supply pipe 782, the first detergent may directly flow into the junction hole 1154 together with the water.

The first detergent supply portion 3000 may include a first cover 3100 inserted into the first detergent injection hole 3110 to prevent the inner circumferential surface of the first detergent injection hole 3110 from being exposed. The first cover 3100 may be formed in a ring shape and coupled to the inner circumferential surface of the first detergent injection hole 3110 so as to serve as the first detergent injection hole 3110.

The first cover 3100 may prevent the cross section of the auxiliary cover 2000 from being exposed to the user, thereby preventing safety accidents. In addition, the first cover 3100 may further include a guide step 3120 protruding from the inner circumferential surface thereof. The guide step 3120 may serve as a buffer zone for separating the inner circumferential surface of the auxiliary cover 2000 from the user's body. The guide step 3120 may have a slope capable of guiding the first detergent dropped on the outer circumferential surface of the first detergent injection hole 3110 to the first receiving portion (I).

The second detergent supply portion 4000 may be configured to inject the second detergent such as a bleach or a fabric softener into the second receiving portion (II).

The second detergent supply portion 4000 may be formed as a simple injection hole or through hole for injecting the second detergent into the second receiving portion (II) similarly to the first detergent supply portion 3000.

However, a time point at which the second detergent is injected may be more important than the injection amount.

Therefore, the second detergent supply portion 4000 may include the detergent housing 4200 accommodated in the second receiving portion (II) and configured to store the second detergent and a second cover 4100 disposed above the detergent housing 4200 and mounted on the second detergent injection hole 4110.

The detergent housing 4200 may be connected to second supply pipe 783 to receive water. The detergent housing 4200 may be designed to supply the second detergent to the second receiving portion (II) only when the detergent housing 4200 receives a certain amount of water from the second supply pipe 783.

Even when a certain amount of water is supplied from the first receiving portion (I), the detergent housing 4200 may prevent the water from flowing into the inside of the detergent housing 4200. That is, even when a large amount of water is supplied from the first receiving portion (I) or the first supply pipe 782 to the second receiving portion (II), the detergent housing 4200 may prevent the water supplied from the first supply pipe 782 from coming into contact with the second detergent.

Thus, the laundry treating apparatus according to the present disclosure may supply the second detergent to the tub 300 through the detergent housing 4200 and the second cover 4100 at a proper time point.

The tub 300 may include a heater mounting portion 312 for accommodating a heater on the bottom surface of the tub 300, and a hub 311 through which the rotation shaft passes. The drain pipe 810 as well as the heater may be connected to the heater mounting portion 312. The tub bracket 420 may be extended and disposed on the outer circumferential surface of the tub body 310.

The junction duct 1150 may include an installation protrusion 1158 for fixing the detergent housing 4200 of the second detergent supply portion 4000.

Figure 11:
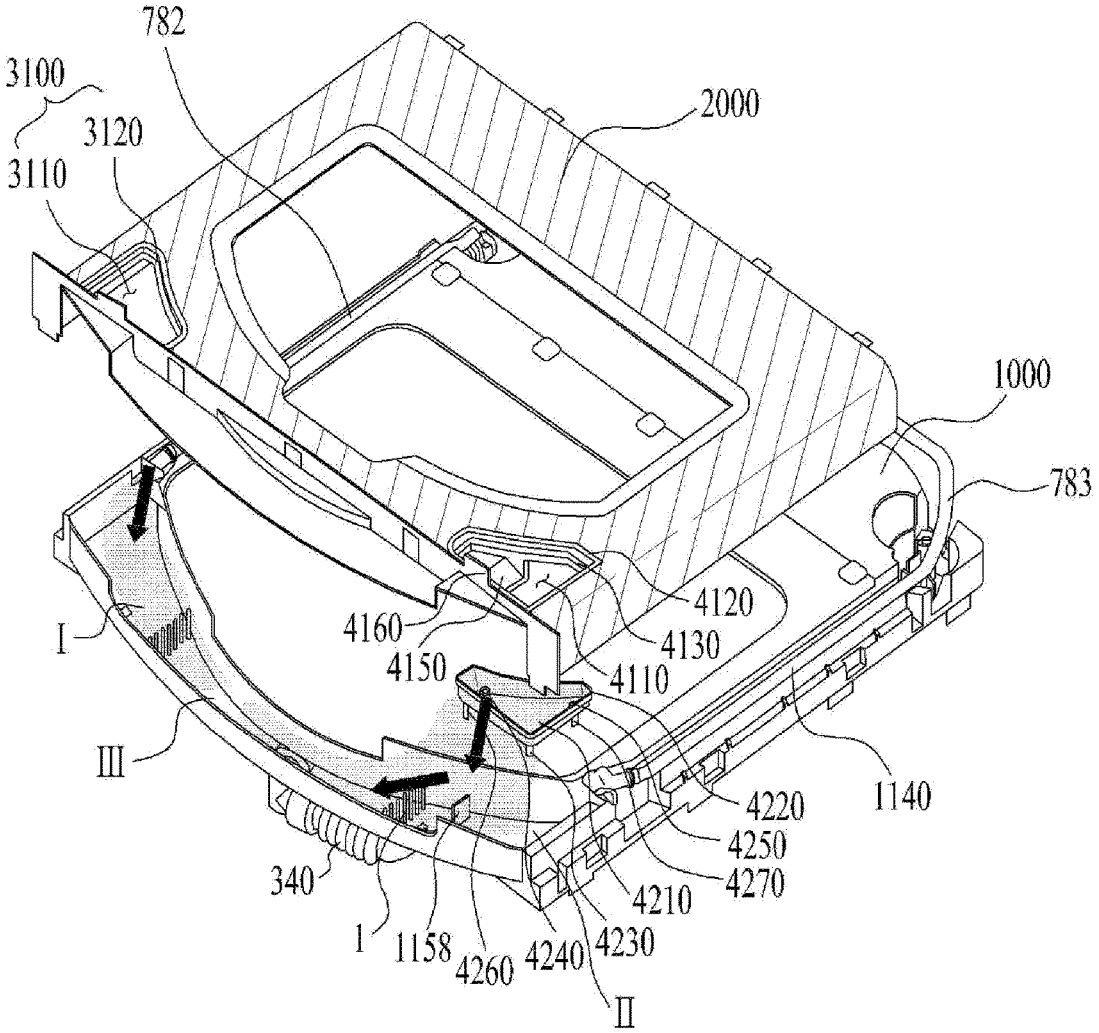
FIG. 11 shows a situation in which water is supplied from the top cover of the laundry treating apparatus according to the present disclosure.

FIG. 11 shows the effect of the top cover 1000 according to the present disclosure.

Since the laundry treating apparatus according to the present disclosure is provided as an auxiliary/small laundry treating apparatus, there may be an insufficient space to install various components inside the housing.

Since the top cover 1000 coupled above the housing may be configured to store detergents, receive water, and deliver the detergents to the tub 300, thereby simplifying the internal structure of the housing.

In addition, since all detergents such as a fabric softener, a bleach, etc. are supplied to the tub 300 through the top cover 1000, flow paths through which the detergents flow into the tub 300 may be integrated.

Since both the first supply pipe 782 and the second supply pipe 783 are mounted on a guide portion 1140 of the top cover 1000, the first supply pipe 782 and the second supply pipe 783 may be prevented from being exposed to the inside of the housing or escaping into the housing.

In addition, since the top cover 1000 is configured to receive water directly from the water supply portion 700 through the first supply pipe 782 and contain the water, no housing or detergent box may be required to store a detergent.

In addition, even when an excessive amount of water is supplied to the first supply pipe 782 or the second supply pipe 783, the water may flow into the junction duct 1150 provided on the top cover 1000 and then move to the tub 300, thereby preventing the water from overflowing out of the top cover 1000.

The second detergent supply portion 4000 may include the detergent housing 4200 configured to store the second detergent, and the second supply pipe 783 may be connected to the detergent housing 4200. In this case, even when an excessive amount of water is supplied to the detergent housing 4200 through the second supply pipe 783 and the second detergent overflows out of the detergent housing 4200, the second detergent and water may flow into the junction duct 1150 and be supplied to the tub 300, so that there may be no problems.

Accordingly, no extra components may be required to prevent water from overflowing out of the second detergent supply portion 4000.

Specifically, the second cover 4100 may not need to prevent water from overflowing from the detergent housing 4200 to the outside. That is, the second cover 4100 may include a locking portion 4120 coupled to the second detergent injection hole 4110, a guide step 4130 protruding from the locking portion 4120 to prevent exposure of the sides of the auxiliary cover 2000, a siphon cover pipe 4140 that is provided in the detergent housing 4200 and configured to generate a siphon phenomenon, and a water level guide portion 4150 configured to inform the amount of the second detergent injected into the detergent housing 4200.

The second cover 4100 may be disposed to be spaced apart from the upper surface of the detergent housing 4200 so that the second detergent or water excessively injected into the detergent housing 4200 may move to the second receiving portion (II).

The detergent housing 4200 may include a guide surface 4220 connected to the second supply pipe 783, a storage unit 4210 provided inside the guide surface 4220 and configured to store the second detergent, and a siphon pipe 4240 provided on one side of the storage unit 4210 and accommodated in the siphon cover pipe 4140.

A support protrusion 4270 supported by or fixed to the second receiving portion (II) may be provided on the outer surface of the storage unit 4210. In addition, a discharger 4260 configured to discharge the second detergent may be provided on the outer surface of the storage unit 4210.

If water reaches an upper portion of the storage unit 4210, it may mean that a softener needs to be supplied to the tub 300. That is, it may mean that water has been supplied to the second supply pipe 783 and the siphon phenomenon has already occurred, so that the second detergent has been discharged to the discharger 4260.

Accordingly, the upper surface of the storage unit 4210 may be configured to allow water supplied from the second supply pipe 783 to overflow into the second receiving portion (II) by being spaced apart from the second cover 4100. As a result, no complicated configuration may be required to prevent water from overflowing from the second detergent supply portion 4000.

As it is apparent from the above description, the present disclosure has the following effects.

According to the present disclosure, a door that opens and closes a laundry storage space may open inside a cabinet.

According to the present disclosure, the volume of a detergent box containing a detergent and the volume of a softener box containing a softener or another detergent may expand.

According to the present disclosure, it is possible to prevent water from overflowing out of a detergent box containing a detergent and a softener box containing a softener or another detergent. In addition, According to the present disclosure, a structure for connecting a detergent box containing a detergent and a softener box containing a softener or another detergent to a tub may be simplified or unified.

According to the present disclosure, it is possible to prevent a detergent box containing a detergent, a softener box containing a softener or another detergent, and a supply pipe for supplying water to the detergent box and the softener box from being exposed inward.

According to the present disclosure, it is possible to accommodate and support at least parts of a detergent box containing a detergent, a softener box containing a softener or another detergent, and a supply pipe for supplying water to the detergent box and the softener box.

According to the present disclosure, no detergent box may be required.

It will be apparent to those skilled in the art that the present disclosure may be embodied in other specific forms without departing from the spirit and essential characteristics of the present disclosure. Thus, the above embodiments are to be considered in all respects as illustrative and not restrictive. The scope of the present disclosure should be determined by reasonable interpretation of the appended claims and all change which comes within the equivalent scope of the disclosure are included in the scope of the disclosure.

What is claimed is:

1. A laundry treating apparatus comprising:

a housing;

a tub disposed in the housing and configured to receive water;

a drum rotatably disposed in the tub and configured to receive laundry;

a water supply configured to supply water to the tub;

a first detergent supply configured to receive a first detergent to be supplied to the tub;

a second detergent supply spaced apart from the first detergent supply and configured to receive a second detergent to be supplied to the tub; and a top cover coupled to an upper portion of the housing and configured to receive the first detergent from the first detergent supply and to receive the second detergent from the second detergent supply, wherein the top cover comprises a junction duct that connects the first detergent supply and the second detergent supply, wherein the junction duct defines a junction hole located between the first detergent supply and the second detergent supply, and wherein the junction duct is configured to (i) guide the first detergent from the first detergent supply to a first position between the junction hole and the second detergent supply, and (ii) guide the second detergent from the second detergent supply to a second position between the junction hole and the first detergent supply.

2. The laundry treating apparatus of claim 1, wherein the junction duct is disposed above a front portion of the tub.

3. The laundry treating apparatus of claim 1, wherein the junction duct is coupled to the upper portion of the housing, or the junction duct is mounted on the upper portion of the housing.

4. The laundry treating apparatus of claim 1, wherein the junction duct defines:

a first receiving portion configured to receive the first detergent from the first detergent supply;

a second receiving portion configured to receive the second detergent from the second detergent supply; and a transfer portion that connects the first receiving portion and the second receiving portion to each other, and wherein the junction hole is connected to the tub and passes through the transfer portion.

5. The laundry treating apparatus of claim 4, wherein a front-rear width of each of the first receiving portion and the second receiving portion is less than a front-rear width of the transfer portion.

6. The laundry treating apparatus of claim 5, wherein the front-rear width of the transfer portion decreases along a lateral direction from each of the first receiving portion and the second receiving portion toward the junction hole.

7. The laundry treating apparatus of claim 4, wherein a height of the junction hole with respect to a bottom of the tub is less than a height of each of the first receiving portion and the second receiving portion with respect to the bottom of the tub.

8. The laundry treating apparatus of claim 4, wherein a height of each of the first receiving portion and the second receiving portion with respect to a bottom of the tub is greater than a height of the transfer portion with respect to the bottom of the tub.

9. The laundry treating apparatus of claim 8, wherein the height of the transfer portion decreases along a lateral direction from each of the first receiving portion and the second receiving portion toward the junction hole.

10. The laundry treating apparatus of claim 4, wherein the first receiving portion and the second receiving portion are disposed at ends of the junction duct, respectively, and wherein the transfer portion is disposed between the first receiving portion and the second receiving portion.

11. The laundry treating apparatus of claim 10, wherein the transfer portion comprises:

a first filter disposed between the first receiving portion and the junction hole; and a second filter disposed between the second receiving portion and the junction hole.

12. The laundry treating apparatus of claim 4, wherein the tub comprises an injection pipe connected to the junction hole and spaced apart from the junction hole, the injection pipe being disposed at a position defining the shortest distance between the junction hole and the tub.

13. The laundry treating apparatus of claim 12, wherein the junction duct further comprises:

an integrated pipe that extends outward from the junction hole and is configured to guide the first detergent and the second detergent toward the tub; and a junction pipe that connects the integrated pipe to the injection pipe and is configured to supply the first detergent and the second detergent to the tub.

14. The laundry treating apparatus of claim 13, wherein the junction pipe is a corrugated pipe or is made of an elastic material.

15. The laundry treating apparatus of claim 4, wherein the first receiving portion, the second receiving portion, and the transfer portion are disposed above a front portion of the tub, and wherein the water supply comprises:

a water supply valve disposed at a rear portion of the tub;

a first supply pipe that extends from the water supply valve to the first receiving portion; and a second supply pipe that extends from the water supply valve to the second receiving portion.

16. The laundry treating apparatus of claim 15, wherein the top cover further comprises extension portions that extend from lateral ends of the junction duct to a rear side of the housing, respectively, each of the extension portions being coupled to one of lateral sides of the housing, and wherein the extension portions are configured to support at least a part of the first supply pipe and at least a part of the second supply pipe.

17. The laundry treating apparatus of claim 16, further comprising an auxiliary cover that is coupled to an upper portion of the junction duct and an upper portion of each of the extension portions, the auxiliary cover covering the junction duct and each of the extension portions, wherein the first detergent supply and the second detergent supply pass through the auxiliary cover, or the first detergent supply and the second detergent supply are mounted on the auxiliary cover.

18. The laundry treating apparatus of claim 17, wherein the auxiliary cover defines:

a first detergent injection hole at a position above the first receiving portion, the first detergent supply comprising the first detergent injection hole; and a second detergent injection hole at a position above the second receiving portion, the second detergent supply comprising the second detergent injection hole, and wherein the second detergent supply further comprises a detergent housing inserted into the second detergent injection hole and configured to receive the second detergent, the detergent housing being connected to the second supply pipe.

19. The laundry treating apparatus of claim 17, further comprising a cabinet that defines an opening, the housing being configured to be inserted into and withdrawn from the cabinet through the opening, wherein the auxiliary cover is coupled to a part of the top cover that is configured to be exposed outside the cabinet based on the housing being withdrawn from the cabinet.

20. A laundry treating apparatus comprising:

a housing;

a tub disposed in the housing and configured to receive water;

a drum rotatably disposed in the tub and configured to receive laundry;

a first receiving portion defined at a top side of the tub and configured to receive a first detergent to be supplied to the tub;

a second receiving portion defined at the top side of the tub and configured to receive a second detergent to be supplied to the tub, the second receiving portion being spaced apart from the first receiving portion; and a transfer portion connected to the first receiving portion and the second receiving portion and configured to supply the first detergent and the second detergent to the tub, the transfer portion connecting the first receiving portion and the second receiving portion to each other at the top side of the tub, wherein the transfer portion defines a junction hole that is connected to the tub and passes through the transfer portion, the junction hole being defined at a position between the first receiving potion and the second receiving portion, and wherein the transfer portion is configured to (i) guide the first detergent from the first receiving portion to a first position between the junction hole and the second receiving portion, and (ii) guide the second detergent from the second receiving portion to a second position between the junction hole and the first receiving portion.

21. The laundry treating apparatus of claim 20, wherein the transfer portion connects the first receiving portion and the second receiving portion to each other such that at least a portion of the first detergent supplied to the first receiving portion is transferred to the second receiving portion, or that at least a portion of the second detergent supplied to the second receiving portion is transferred to the first receiving portion.

22. The laundry treating apparatus of claim 21, wherein a height of the junction hole with respect to a bottom of the tub is less than a height of each of the first receiving portion and the second receiving portion with respect to the bottom of the tub.

23. The laundry treating apparatus of claim 21, wherein a front-rear width of the transfer portion is less than a front-rear width of each of the first receiving portion and the second receiving portion.

24. The laundry treating apparatus of claim 23, wherein the front-rear width of the transfer portion decreases along a lateral direction from each of the first receiving portion and the second receiving portion toward the junction hole.

25. A laundry treating apparatus comprising:

a housing;

a tub disposed in the housing and configured to receive water;

a drum rotatably disposed in the tub and configured to receive laundry;

a driver disposed below the tub and configured to rotate the drum;

a water supply connected to an external water supply source and configured to supply water to the tub;

a detergent supply configured to receive water from the water supply and to supply a detergent to the tub;

a top cover coupled to an upper portion of the housing and configured to support the water supply or the detergent supply; and an auxiliary cover that is coupled to an upper portion of the top cover and covers the water supply or the detergent supply, wherein the water supply comprises:

a branch portion disposed at a rear surface of the housing and configured to receive water from the external water supply source, and a supply pipe that extends from the branch portion and configured to guide the water from the branch portion to the detergent supply, wherein the top cover comprises an extension portion disposed at at least one side of the top cover and configured to detachably support the supply pipe, wherein the auxiliary cover covers the extension portion of the top cover, and wherein the extension portion comprises a coupling step that extends outward from the at least one side of the top cover, the coupling step being coupled to a side of the auxiliary cover.

26. The laundry treating apparatus of claim 25, wherein the top cover is configured to support a lower portion of the water supply or a lower portion of the detergent supply.

27. The laundry treating apparatus of claim 25, further comprising a water level sensor configured to sense a water level in the tub, wherein the top cover further comprises an installation portion that supports the water level sensor.

28. The laundry treating apparatus of claim 25, further comprising a cabinet that defines a front opening, the housing being configured to be inserted into and withdrawn from the cabinet through the front opening, wherein a part of the top cover is configured to be exposed outside the cabinet based on the housing being withdrawn from the cabinet, and wherein an area of the auxiliary cover faces the part of the top cover configured to be exposed outside the cabinet.

29. The laundry treating apparatus of claim 28, wherein the top cover and the auxiliary cover are made of different materials from each other.

* * * * *